US006571773B1

(12) United States Patent
Yamakado et al.

(10) Patent No.: US 6,571,773 B1
(45) Date of Patent: Jun. 3, 2003

(54) FUEL INJECTOR AND INTERNAL COMBUSTION ENGINE

(75) Inventors: Makoto Yamakado, Tsuchiura (JP); Yoshiyuki Tanabe, Hitachinaka (JP); Toshio Takahata, Atsugi (JP); Hiromasa Kubo, Yokohama (JP); Yasunaga Hamada, Hitachinaka (JP); Yoshio Okamoto, Minori (JP); Yuzo Kadomukai, Ishioka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 09/628,717

(22) Filed: Jul. 28, 2000

(30) Foreign Application Priority Data

Jul. 28, 1999 (JP) ..... 11-214333

(51) Int. Cl.[7] ..... F02M 51/00

(52) U.S. Cl. ..... 123/490; 123/486; 361/152; 361/154

(58) Field of Search ..... 123/490, 486; 361/152, 153, 154

(56) References Cited

U.S. PATENT DOCUMENTS

| | | | | |
|---|---|---|---|---|
| 4,190,022 A | | 2/1980 | Long | |
| 4,656,989 A | | 4/1987 | Yakuwa | |
| 5,442,515 A | * | 8/1995 | Wallaert | 316/187 |
| 5,531,198 A | | 7/1996 | Matsuura | |
| 5,941,216 A | | 8/1999 | Arakawa | |
| 5,992,391 A | | 11/1999 | Yamakado et al. | |
| 6,129,073 A | | 10/2000 | Yamakado et al. | |
| 6,431,155 B1 | | 8/2002 | Yamakado et al. | |

FOREIGN PATENT DOCUMENTS

| | | |
|---|---|---|
| DE | 19606965 | 8/1997 |
| DE | 19828672 | 1/1999 |
| JP | 06241137 | 8/1994 |
| JP | 09317543 | 12/1997 |

* cited by examiner

*Primary Examiner*—Willis R. Wolfe
*Assistant Examiner*—Johnny H. Hoang
(74) *Attorney, Agent, or Firm*—Antonelli, Terry, Stout & Kraus, LLP

(57) ABSTRACT

The target peak current value, where a current value is reduced in conformity to a drop in the voltage of a battery 18 is stored in target peak current storage unit 68. ON-signals are sent from current control circuit 56 to power transistor 50 in response to the injection command pulse coming from engine controller 58 so that current is applied to coil 20. Then, the current flowing to coil 20 is detected by the current detecting resistor 52. Comparator 62 compares this detected current and the target peak current value read from the target peak current storage unit 68 conforming to the voltage of battery 18. If agreement is found between these two values, OFF-signals are sent to power transistor 50 from current control circuit 56 in response to the switching command coming from comparator 62. Then, On/Off signals to effect holding of the coil 20 are sent from current control circuit 56 to power transistor 50. The linearity of the injection volume despite changes in battery voltage can be maintained.

15 Claims, 19 Drawing Sheets

RELATIONSHIP BETWEEN BATTERY VOLTAGE AND COIL CURRENT(CONSTANT RESISTANCE AND FUEL PRESSURE)

TARGET PEAK CURRENT VALUE AND ARRIVAL TIME

| BATTERY VOLTAGE (V) | 14 | 12 | 10 | 8 | 6 |
|---|---|---|---|---|---|
| TARGET PEAK CURRENT VALUE (A) | 8 | 7.2 | 6.2 | 5.1 | 4 |
| PEAK ARRIVAL TIME (ms ) | 0.24 | 0.25 | 0.27 | 0.32 | 0.40 |

RELATIONSHIP BETWEEN RESISTANCE AND COIL CURRENT(CONSTANT BATTERY VOLTAGE AND FUEL PRESSURE)

TARGET PEAK CURRENT VALUE AND ARRIVAL TIME

| RESISTANCE ( Ω) | 1.4 | 1.6 | 1.8 | 2.0 | 2.2 |
|---|---|---|---|---|---|
| TARGET PEAK CURRENT VALUE (A) | 8 | 7.3 | 6.8 | 6.4 | 6 |
| PEAK ARRIVAL TIME (ms ) | 0.24 | 0.25 | 0.26 | 0.27 | 0.28 |

RELATIONSHIP BETWEEN FUEL PRESSURE AND OPTIMUM PEAK CURRENT(CONSTANT BATTERY VOLTAGE AND RESISTANCE)

TARGET PEAK CURRENT VALUE AND ARRIVAL TIME

| BURNING PRESSURE ( MPa) | 7 | 8 | 9 | 10 | 11 |
|---|---|---|---|---|---|
| TARGET PEAK CURRENT VALUE (A) | 8 | 8.2 | 8.9 | 9.2 | 9.8 |
| PEAK ARRIVAL TIME (ms ) | 0.24 | 0.28 | 0.32 | 0.38 | 0.48 |

TARGET PEAK CURRENT MAP FIG. 15B

| FUEL PREESSURE (MPa) \ VOLTAGE (V) | 6 | 8 | 10 | 12 | 14 |
|---|---|---|---|---|---|
| 7 | 4 | 5.2 | 6.1 | 7.0 | 8.0 |
| 9 | 4.2 | 5.4 | 6.8 | 8.0 | 9.0 |
| 12 | 4.4 | 5.6 | 7.0 | 8.4 | 9.5 |

TARGET PEAK ARRIVAL TIME MAP FIG. 15C

| FUEL PREESSURE (MPa) \ VOLTAGE (V) | 6 | 8 | 10 | 12 | 14 |
|---|---|---|---|---|---|
| 7 | 0.40 | 0.32 | 0.28 | 0.28 | 0.23 |
| 9 | 0.56 | 0.46 | 0.40 | 0.37 | 0.36 |
| 12 | 0.72 | 0.59 | 0.52 | 0.49 | 0.47 |

FUEL INJECTOR AND INTERNAL COMBUSTION ENGINE

BACKGROUND OF THE INVENTION

The present invention relates to an electromagnetic fuel injector system and an internal combustion engine; and, more particularly, the invention relates to an electromagnetic fuel injector system which is directly driven by a battery voltage, and an internal combustion engine equipped with said fuel injector system.

The electromagnetic fuel injector system is used in an internal combustion engine, for example, as provided in a vehicle, such as car.

The electromagnetic fuel injection valve (hereafter simply called an "injector") of this electromagnetic fuel injector system comprises a nozzle provided with fuel injection hole, a plunger which is inserted in the nozzle in a freely reciprocating manner with a valve on the tip thereof, a return spring to give elastic force to the plunger to bias it in the direction of closing valve, and a coil to provide the plunger with electromagnetic force for opening the valve, using the power supplied from a battery. When current is applied to the coil, the plunger is attracted and the valve is released from the valve seat to open a fuel injection hole; and then fuel is jetted out of the fuel injection hole. When application of current to the coil is suspended, magnetic attraction by the coil is damped, and the valve is closed by the elastic force of the return spring.

The volume of injection by the injector is controlled by the valve opening command time. Generally, there is a delay of valve response with respect to the valve opening command time and the valve closing command time. An area where perfect linearity cannot be established occurs in the fuel injection volume characteristics showing the relationship between the valve opening command time and the injection volume. This requires the injector to have a linearity established over an extensive field. However, the injector mounted on an internal combustion engine, typically designed for reduced manufacturing costs, is required to ensure accurate injection with less fuel, and linearity with respect to a short valve opening command time is very important. To meet these requirements, a great variety of injector driving methods have been proposed.

For example, a saturated method (voltage drive) and peak hold method (current drive) are well known injector drive methods, as disclosed in "Electronically Controlled Gasoline Injection" (by Fujisawa and Kobayashi, 1987, Sankaido Publishing Co., Ltd.).

Generally in the saturated method, many turns of coil are used, so that the drive current continues to increase even after the valve lifting has been terminated, until it reaches the point close to the saturated current, which is restricted by the coil internal resistance and the drive circuit internal resistance. The circuit impedance is higher than that in the peak hold method, and the rising edge of the current flowing to the coil is less sharp due to inductance. If the saturated current value is properly set by adjusting the coil internal resistance and drive circuit internal resistance, there is no need to provide a current control circuit, thereby allowing manufacture at reduced costs.

In the peak hold method, a smaller number of coil turns are used. The circuit inductance and circuit impedance are low, and the rising edge of the current during the valve opening operation is sharper than that which occurs in the saturated method. However, the coil inductance and impedance are low in this method. So, if the current is continuously applied to the coil in a specified state, excessive current will flow to the coil to damage it. To prevent this, this method uses a current limiting mechanism provided in the drive circuit. When the current flowing to the coil has reached a preset value (set peak current), the duty of voltage applied to the coil is dropped from 100%, thereby restricting the current to the value required to hold the valve.

Comparison of the above two methods shows that the peak hold method with high current response is more frequently used in order to take advantage of the linearity of injection volume with respect to valve opening command time in the low injection area.

For example, Japanese Patent Laid-Open No. 241137/1994 discloses an electromagnetic fuel injector system where the fuel pressure is detected to increase the target peak current value according to the fuel pressure or to prolong the current switching time, thereby adjusting the magnetic attraction, namely, the drive force with respect to the changes of the load applied to the valve body.

The fuel injector disclosed in Japanese Patent Laid-Open No. 241137/1994, however, is not directly driven by the battery voltage. It has a voltage boost circuit and low voltage circuit, thereby eliminating any need for consideration being given to changes in the electric circuit system during driving.

In other words, the electromagnetic fuel injector driven directly by a battery voltage requires consideration to be given not only to the changes of loads applied to the valve body, but also to the changes occurring to the electric circuit comprising the battery, coil and harness, such as the drop of battery voltage due to startup or abrupt change of electric load, to the secular change of the resistance of the harness including the coil, and to the increase of resistance due to heat generation.

With the battery voltage being applied directly to the coil, a drop of the battery voltage will delay the time for coil current to reach the preset peak current value. Moreover, a substantial drop of battery voltage may prevent the coil current from reaching the preset peak current value.

In an electromagnetic fuel injector, the voltage applied to the coil causes the coil current to be delayed by the inductance component of the coil. Delay between the input magnetomotive force (product of current and number of coil turns) and magnetic attraction is also caused by an eddy current. This delay will turn into a kind of integrating filter; therefore, not only the peak current value, but also the current application time must be taken into account in order to achieve linearity also in the low injection area with the magnetic attraction assuming an appropriate value.

In other words, when the peak hold method is used, the injector is not directly driven by the battery voltage in the prior art; therefore, the configuration thereof is not made optimum to achieving the required linearity of injection volume under each condition, with respect to the changes occurring to the electric circuit comprising the battery, coil and harness.

SUMMARY OF THE INVENTION

An object of the present invention is to provide a fuel injector system and internal combustion engine capable of maintaining the linearity of injection volume with respect to the changes in the state of the electric circuit provided to drive the electromagnetic fuel injection valve.

The above object can be attained by providing a fuel injector system which comprises a current application controller which controls the drive of the valve body, installed on an electromagnetic fuel injection valve, by controlling the current so that current flows to a coil to generate an electromagnetic force for driving said valve body until the current driving said valve body in the direction of opening the valve becomes greater than that of holding said valve body open, and by controlling current so that a change occurs to the current application time when driving said valve body in the direction of opening; wherein said current application controller allows current to be applied to reduce the maximum current in the event of increase of said current application time when driving said valve body in the direction of opening, said valve. In this case, it is preferred that current be applied to the coil installed on the electromagnetic fuel injection valve without boosting the battery voltage, and that a current application circuit to allow current to flow from the battery to the coil be provided.

The fuel injector comprises (1) a voltage detecting means to detect the voltage of the battery connected to said current application circuit, (2) a current detecting means to detect the current flowing to the coil connected to said current application circuit, and (3) a current value storage means to store the target peak current value in conformity to the battery voltage.

Here, the current application controller captures the target peak current value in conformity to the voltage detected by said voltage detecting means from said current detecting means, compares said target peak current value to the current detected by said current detecting means, and controls the current application using as a target value the current value which is smaller than said target peak current value, on conditions of agreement of said two current values.

In this case, the current storage means preferably stores the target peak current, where the current is reduced in conformity to a drop in the voltage of the battery connected to the electric circuit.

Furthermore, said injector comprises (1) a combined resistance estimating means to estimate the combined resistance, including the resistance of said current application circuit to connect the battery with the coil, and the resistance of the coil connected to said current application circuit, (2) a current detecting means to detect current flowing to said current application circuit, and (3) a current storage means to store the target peak current in conformity to said combined resistance; wherein said current application controller captures from said current storage means the target peak current in conformity to the resistance estimated by said combined resistance estimating means, compares this target peak current with the current, detected by the current detecting means, and controls current application using as a target value the current value which is smaller than said target peak current value, on conditions of agreement of said two current values.

In this case, the combined resistance estimating means is preferably configured to ensure that the estimate changes in the composed resistance, including the resistance of said current application circuit and the resistance of the coil connected to said current application circuit, from the relationship between the current value stored in said storage means and the combined resistance, using the time elapsed after start of current application and the current value after lapse of a specified time.

It is also preferred that a voltage detecting means be provided, and the storage means to store the relationship between the current and combined resistance store the relationship between the current and combined resistance with respect to voltages of multiple batteries, and configuration be designed to estimate the combined resistance including the resistance of said current application circuit and the resistance of the coil connected to said current application circuit, based on the battery voltage detected by the voltage detecting means.

It is further preferred to provide control to delay the time to switch the state of current application from the target peak current value to the holding current value, if there is an increase of the combined resistance including the resistance of the current application circuit and the resistance of the coil connected to this current application circuit.

It is also preferred that the current value storage means stores a target peak current value where the current value is reduced in conformity to an increase of the combined resistance.

Further, a fuel injector comprises (1) a voltage detecting means to detect the voltage of the battery connected to said current application circuit, (2) a current detecting means to detect the current flowing to the coil connected to said current application circuit, and (3) a timing storage means to store the time to switch in conformity to said battery voltage; wherein said current application controller operates to measure the time elapsed from the start of current application in the case of driving the valve body in the direction of opening the valve, captures from said timing storage means the time to switch in conformity to the voltage detected by said voltage detecting means, compares this switching time with said measured time, and controls the current application using as a target value the current value which is smaller for the current flowing to said coil, on conditions of agreement of said two times.

In this case, it is preferred that the timing storage means store the target switching time which is delayed in conformity to a drop of the battery voltage.

Further, the fuel injector comprises (1) a combined resistance estimating means to estimate the combined resistance including the resistance of said current application circuit to connect the battery to the coil, and the resistance of the coil connected to said current application circuit, (2) a current detecting means to detect current flowing to the coil, and (3) a timing storage means to store the time to switch in conformity to said combined resistance; wherein the current application controller operates to measure the time elapsed from the start of current application in the case of driving the valve body in the direction of opening the valve, captures from said timing storage means the time to switch in conformity to the resistance estimated by said combined resistance estimating means, compares this switching time with said measured time, and controls the current application using as a target value the current value which is smaller for the current flowing to said coil, on conditions of agreement of said two times.

In this case, it is preferred to provide control to delay the time to switch the state of current application from the target peak current value to the holding current value, if there is an increase of the combined resistance including the resistance of the current application circuit and the resistance of the coil connected to this current application circuit.

It is also preferable for that the timing storage means to store the target switching time which is delayed in conformity to the increase of the combined resistance.

The above object can also be attained by providing a fuel injector system comprising a current application controller which controls the drive of the valve body, installed on an electromagnetic fuel injection valve, by controlling the current so that current flows to a coil to generate an electromagnetic force for driving said valve body until the current driving said valve body in the direction of opening the valve becomes greater than that of holding said valve body open, and by controlling current so that a change occurs to the current application time when driving said valve body in the direction of opening; wherein said current application controller controls current to the coil, based on fuel injection command pulse having a width which is compensated when there is an increase in current application time.

Furthermore, the above object can also be attained by providing a fuel injector comprising a current application controller which controls the drive of the valve body, installed on an electromagnetic fuel injection valve, by controlling the current so that current flows to a coil to generate an electromagnetic force for driving said valve body until the current driving said valve body in the direction of opening the valve becomes greater than that of holding said valve body open, and by controlling current so that a change occurs to the current application time when driving said valve body in the direction of opening;

wherein said fuel injector comprises a combined resistance estimating means to estimate the combined resistance including the resistance of said current application circuit connected between the battery electrically connected to said coil to supply current thereto and said coil, and the resistance of said coil; and said current application controller controls current to the coil, based on a fuel injection command pulse having a width which is compensated in conformity to the resistance estimated by said combined resistance estimating means.

According to the present invention, delay in the valve closing operation is reduced by allowing current to be applied to reduce the maximum current in the event of an increase of said current application time when driving said valve body in the direction of opening said valve, thereby maintaining the linearity of the injection volume.

By controlling the current to the coil based on a fuel injection command pulse having a width which is compensated when there is can increase in current application time, it is possible to reduce the influence on the fuel injection volume given by the change in the state of the drive circuit which causes the current application time to increase. This allows the linearity of the injection volume to be maintained.

It is also possible to reduce the influence of combined resistance on the fuel injection volume by compensating the pulse width in conformity to the combined resistance, including the resistance of the current application circuit connecting the battery with the coil and the resistance of the coil. This allows the linearity of injection volume to be maintained.

BRIEF DESCRIPTION OF THE DRAWINGS

FIGS. 15B and 15C are tables of the target peak current values and peak arrival times, respectively;

DESCRIPTION OF THE INVENTION

Figure 1:
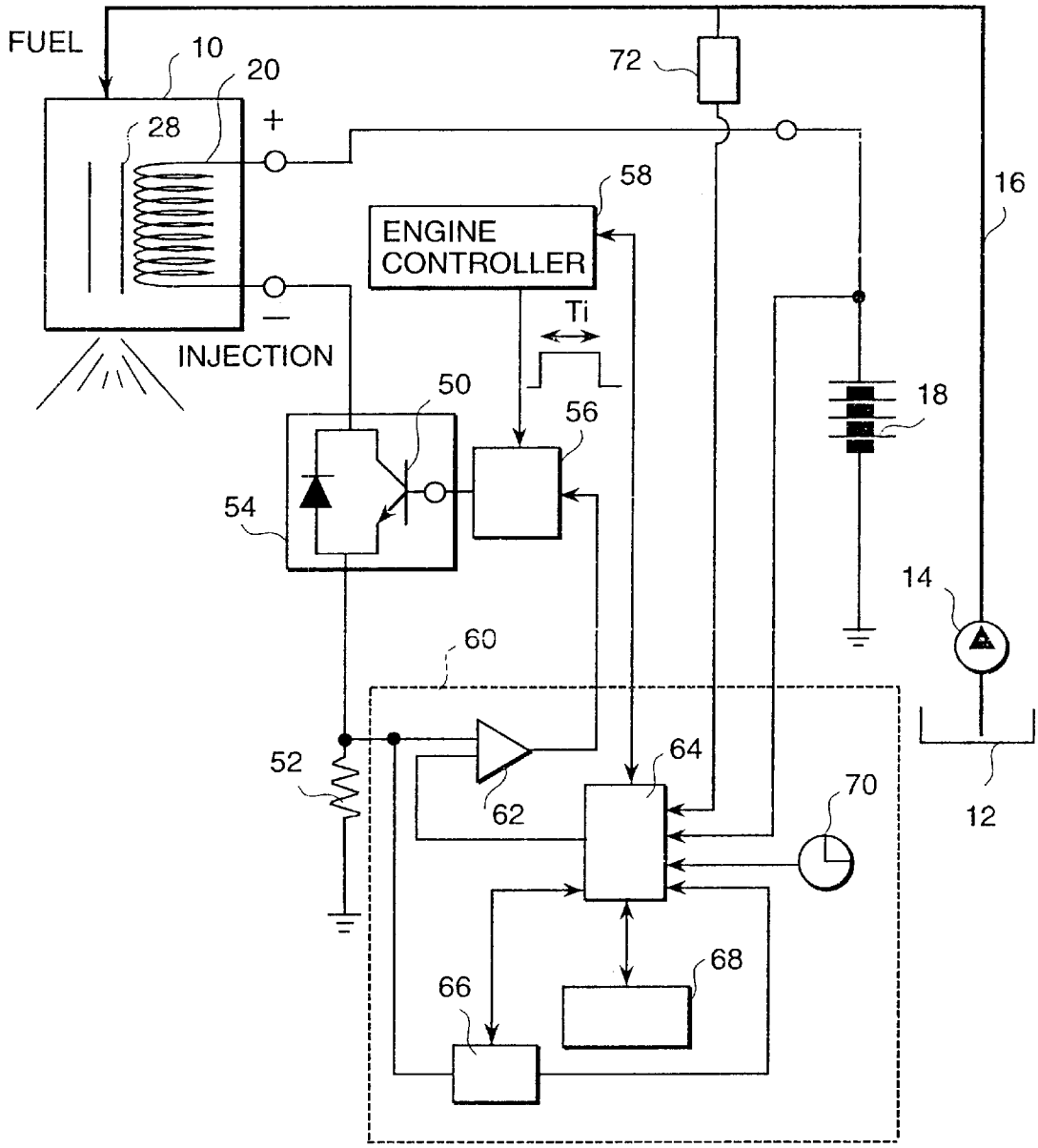
FIG. 1 is a block diagram representing an electromagnetic fuel injection system according to a first embodiment of the invention.

One embodiment of the present invention will be described with reference to the drawings. In FIG. 1, in an internal combustion engine, for example, for a vehicle, such as a car, an electromagnetic fuel injector system is mounted, having a fuel injector valve 10. Fuel in a fuel tank 12 is supplied to this injector valve 10 through a fuel passage 16 by a fuel pump 14, and D.C. power is supplied thereto from a battery 18. When current is applied to a coil 20 built in the injector valve 10, the fuel of the fuel passage 16 is injected into a cylinder of the engine (not illustrated). In other words, the voltage of battery 18 is applied to the coil 20 without being boosted by booster circuit, etc. Therefore, when the resistance of the current application circuit is taken into account, a voltage below the battery voltage is applied to the coil 20.

Figure 2A:
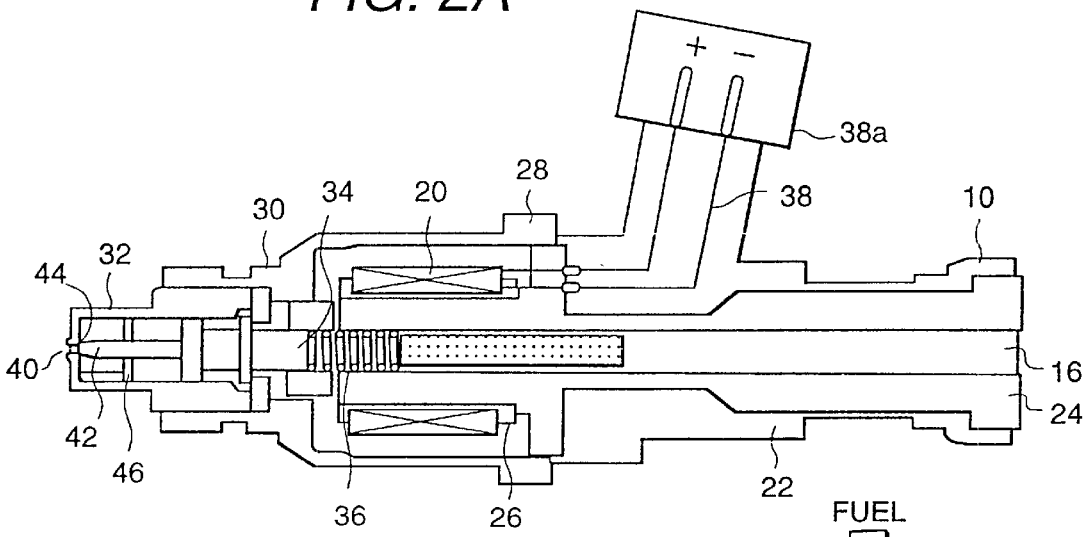
FIG. 2 is a longitudinal sectional view of the injector valve structure, and FIG. 2B an equivalent circuit diagram.
Figure 2B:
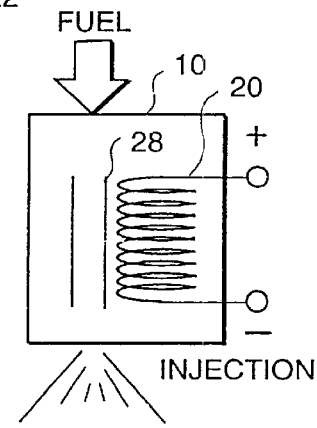

To put it more specifically, as seen in FIG. 2A, the injector valve 10 comprises a cylindrical injector body 22 having a hollow interior, a cylindrical guide 24 inserted into the hollow interior of the cylindrical injector body 22, a bobbin 26 secured in a space on the external surface of the guide 24, in which there is provided a central fuel passage 16, a coil 20 mounted on the bobbin 26, a cylindrical core 28 surrounding the coil 20 and having a yoke portion 30 formed on the tip end of the core 28 integrally therewith, a cylindrical nozzle 32 secured at one end to the internal surface of the yoke 30 and extending axially therefrom, a freely reciprocating plunger 34 mounted in the nozzle 32, and a return spring 36 positioned adjacent to the plunger 34. The coil 20 is connected to the battery 18 through a terminal 38 and connector 38*a*. A fuel injection hole 40 is formed on the tip of the nozzle 32, and the tip of the nozzle 32 is opened or closed by the conical valve (valve body) 42. This valve 42 is formed on the tip of the plunger 34 integrally therewith. In response to the elastic force from the return spring 36, valve 42 closes the fuel injection hole 40 in the seat surface (valve seat) 44. A swirler 46 to atomize the fuel is provided halfway to the tip of the plunger 34. When the voltage from the battery 18 is selectively applied to the coil 20, the coil 20 is energized, and magnetic flux is generated from the coil 20. A magnetic path connecting the yoke 30, core 28 and plunger 34 is formed to generate a magnetic attraction (electromagnetic force) among the core 28, yoke 30, and plunger 34. A force to open the valve is applied to the plunger 34 and valve 42 by this magnetic attraction in opposition to the spring force which seeks to close the valve. When the electromagnetic force exceeds the spring force, the valve 42 is released from the seat surface 44, and fuel is jetted through the fuel injection hole 40. The coil 20 and core 28 can be represented by the equivalent circuit model shown in FIG. 2B.

In the injector valve 10 according to the above description, the load set by the return spring 36 and the fuel pressure applied by the pressurized fuel (fuel pressure) are applied to the valve when the valve is being opened. This requires a greater magnetic attraction than when the valve is held open. Only when this magnetic attraction has reached a level greater than the force including the set load and fuel pressure force will the plunger 34 begin to move. Therefore, the time required to allow a sufficient magnetic attraction to be generated from the coil 20 must be minimized since it affects a delay in the opening of the valve 42. In other words, a quick application of current to the coil 20 is required. Thus, the peak hold method is used for the injector valve 10 in the present embodiment, and both the resistance and inductance of the coil 20 are set to a small value.

The valve 42 can be held open with a smaller magnetomotive force when the valve 42 is held open than when the valve 42 is being opened. This is because fuel is jetted from the fuel injection hole 40 by the opening of valve 42, so that the pressure is balanced on both sides of the valve 42, and the force produced by fuel pressure is reduced. At the same time, an air gap in the electromagnetic circuit including the core 28, yoke 30 and plunger 34 is reduced to cause the magnetic flux density of this air gap to be increased. This makes it possible to make more effective use of the magnetomotive force. Furthermore, when closing the valve 42 after opening it, the magnetomotive force in holding the valve is reduced by cutting off application of voltage from the battery to the coil 20. If the magnetomotive force is reduced below the set load of the return spring 36, then the valve starts to close. If the magnetomotive force is excessive when the valve is held open, the closing of the valve will be delayed. Therefore, when the valve is held open, the valve 42 must be held with a current value close to the limit of holding. Moreover, the resistance and inductance of the coil 20 are set to small values. So if the current is continuously applied to the coil 10 with the battery voltage kept constant, an excessive current will flow to the coil 20, resulting in a response delay and heat generation at the coil 20. To solve this problem, when the valve 42 is kept open, control is made to ensure the current valve appropriate to holding (holding current) is employed, while the current to the coil 20 is also controlled.

To control the current application to coil 20, the present embodiment adopts the following technique. As seen in FIG. 1, a detecting resistor 52 is connected in series to one end of the coil 20 through a power transistor 50. At the same time, the other end of the current detecting resistor 52 is connected to ground, and a diode 54 is connected across both ends of power transistor 50 in an anti-parallel mode.

The power transistor 50, operating as a switching element, is inserted in the current application circuit connection between battery 18 and coil 20 together with the current detecting resistor 52. Current control circuit 56 is connected to the base of the power transistor 50, and the current control circuit 56 is connected to an engine controller 58 and to a current switching control unit 60. The engine controller 58 is configured to output to the current controller 56 the injection command pulse (pulse width Ti) determined according to the engine operation state, such as the throttle opening. The current control circuit 56 turns, on the power transistor 50 in response to the injection command pulse, and starts the application of current to the coil 20. When the current flowing to the coil 20 has reached the target peak current, configuration is designed to repeat on-off operations of power transistor 50 in order to allow a holding current, which is smaller than the target peak current, to flow to the coil 20 in response to the switching command from the current switching control unit 60.

The current switching control unit 60 comprises a comparator 62, a switching current determining unit 64, resistance estimation unit 66, target peak current storage unit 68 and timer 70. Comparator 62 is connected to current detecting resistor 52 and current control circuit 56. The switching current determining unit 64 is connected to the engine controller 58, fuel pressure sensor 72 and battery 18. The target peak current storage unit 68 operating as a current storage means stores the data on the target peak current in conformity to the battery voltage, fuel pressure and harness resistance.

The switching current determining unit 64 captures the output voltage of battery 18 and functions as a voltage detecting means to detect the voltage of battery 18. At the same time, it captures clock signals from timer 70 and functions as a measuring means to measure the time elapsed after start of current application according to these clock signals. Furthermore, the switching current determining unit 64 receives a value of the fuel pressure from the fuel pressure sensor 72, which operates as a fuel pressure detecting means to detect fuel pressure in the fuel passage 16. At the same time, it receives a value of the resistance estimated from the resistance estimating unit 66, namely, the combined resistance including the resistance of the current application circuit connecting the battery 18 with coil 20 and the resistance of coil 20, and it captures said resistance as the harness resistance. It receives from the target peak current storage unit 68 the target peak current value in conformity to the changes in battery voltage, the fuel pressure or the harness resistance, and outputs this target peak current value to the comparator 62. Furthermore, it has the function of a pulse compensating means which compensates the pulse width Ti of the injection command pulse (pulse width set on condition that the battery voltage is within the scope of the rated voltage, the combined resistance denotes the set value, and the fuel pressure inside the fuel passage indicates the set value) according to changes in the voltage of the battery voltage 18, changes in the harness resistance or changes in the fuel pressure. The comparator 62 compares the output of the current detecting resistor 52, which operates as a current detecting means to detect the current flowing to the coil 20, and the target peak current value selected by the switching current determining unit 64. When the value of the current flowing to coil 20 agrees with the target peak current value, a switching command is output to the current control circuit 56. In other words, the power transistor 50, diode 54, current control circuit 56 and current switching control unit 60 are configured to serve as a communication control means.

Figure 3:
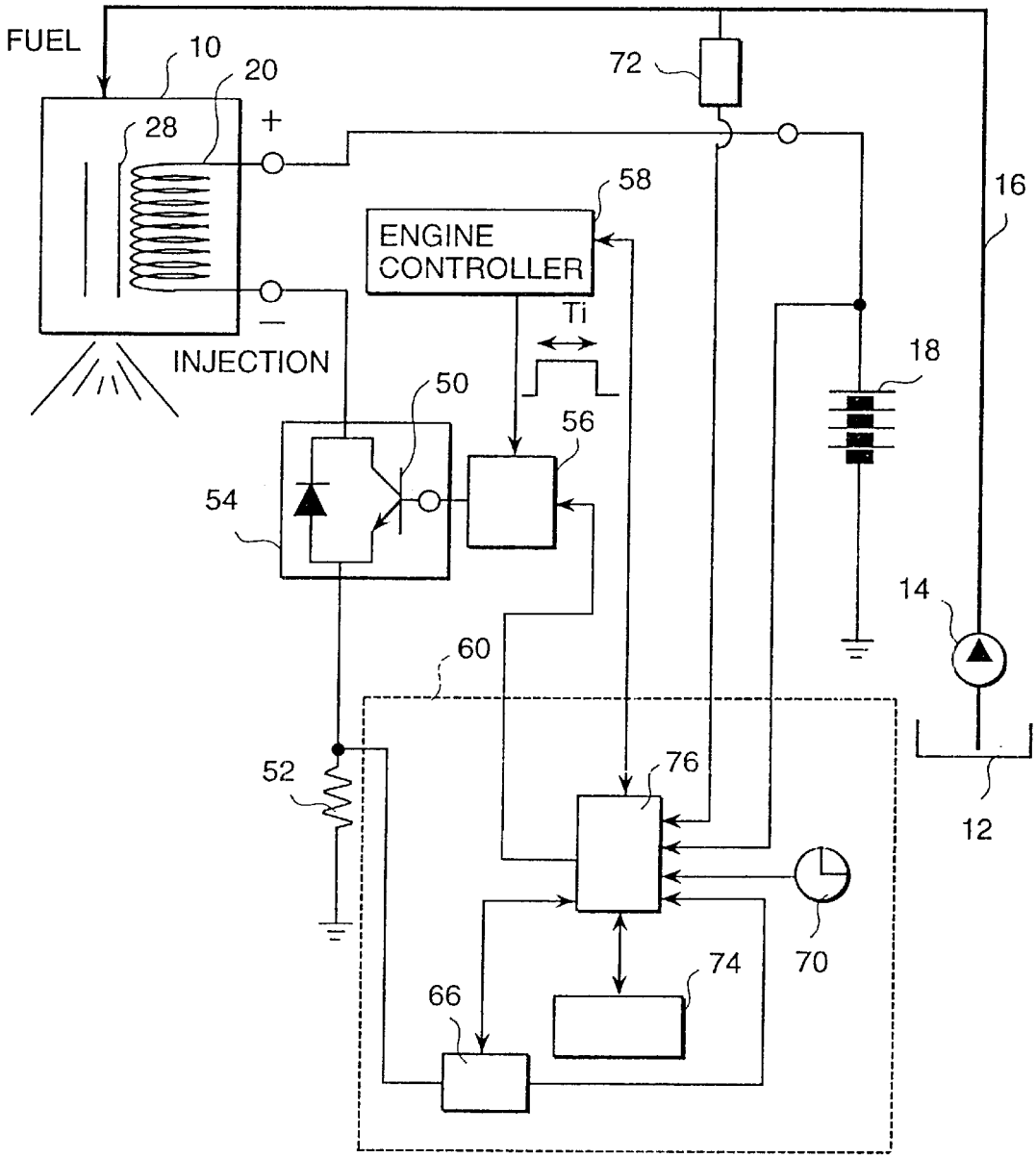
FIG. 3 is a block diagram representing an electromagnetic fuel injection system according to a second embodiment of the invention.

The system shown in FIG. 3 can be used when a switching command to specify the current to be switched is issued from the current switching control unit 60 to the current control circuit 56. In such a case, a target switching time storage unit (timing storage means) 74 is provided instead of target peak current storage unit 68, and a switching timing determining unit 76 is installed instead of the switching current determining unit 64. The switching timing determining unit 76 measures the clock pulses coming from the timer 70 from the start of current application, and issues the switching command from the switching time storage unit 72 to the current control circuit 56, on condition that the time that has elapsed after the start of current application has agreed with the target switching timing.

Figures 4A, 4B:
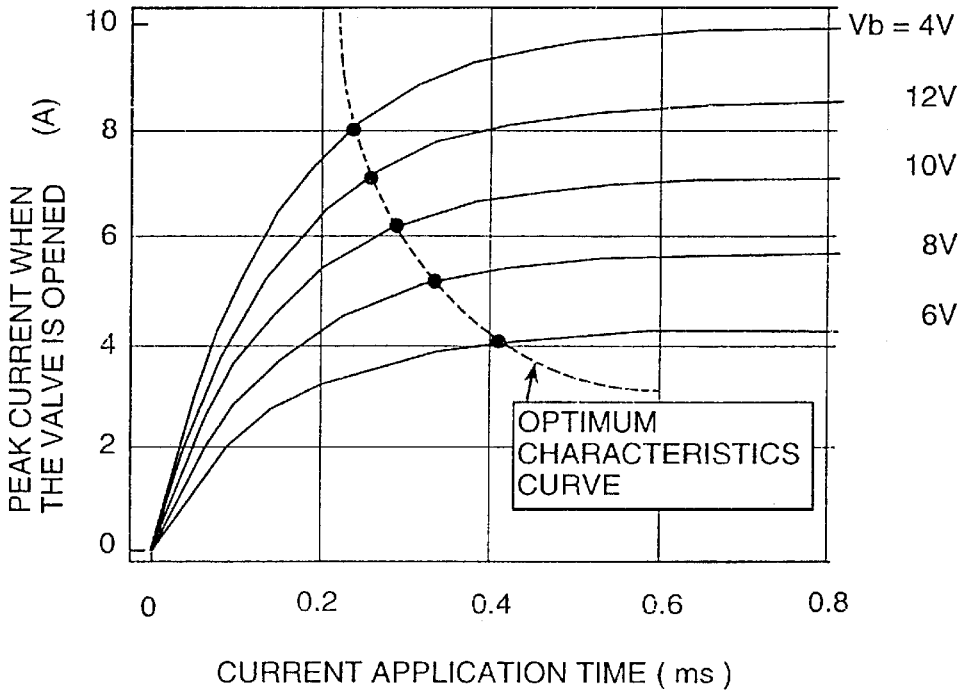
FIG. 4A is a diagram showing the relationship between the battery voltage and coil current.
FIG. 4B is a table showing the relationship between the target current and arrival time.

When only changes in the battery voltage are taken into account, the target peak current storage unit 68 and target switching time storage unit (timing storage means) 74 store the data on the target peak current value and target switching timing determined by the relationship between the battery voltage and coil current in relation to the changes in the voltage of the battery 18, as shown in FIG. 4A and FIG. 4B.

FIG. 4A illustrates the characteristics representing the relationship between the battery voltage and coil current when the resistance of coil 20, the harness resistance and fuel pressure are set at desired values. FIG. 4A shows that the response of the coil current is reduced by drop in the 24 battery voltage. The curve shown by the dotted line in FIG. 4A represents the optimum injection characteristics. This curve can be obtained either by experiment or simulation. The crossing point between this optimum curve and the current response is the optimum target peak current value at each battery voltage. FIG. 4B tabulates the relationship of the characteristics shown in FIG. 4A. The values which are reduced in the direction in which the battery voltage is reduced are given in the table for a target peak current value. The values which increase in the direction in which the battery voltage is reduced are given as the time to reach the peak, namely, target switching timing.

Figure 5:
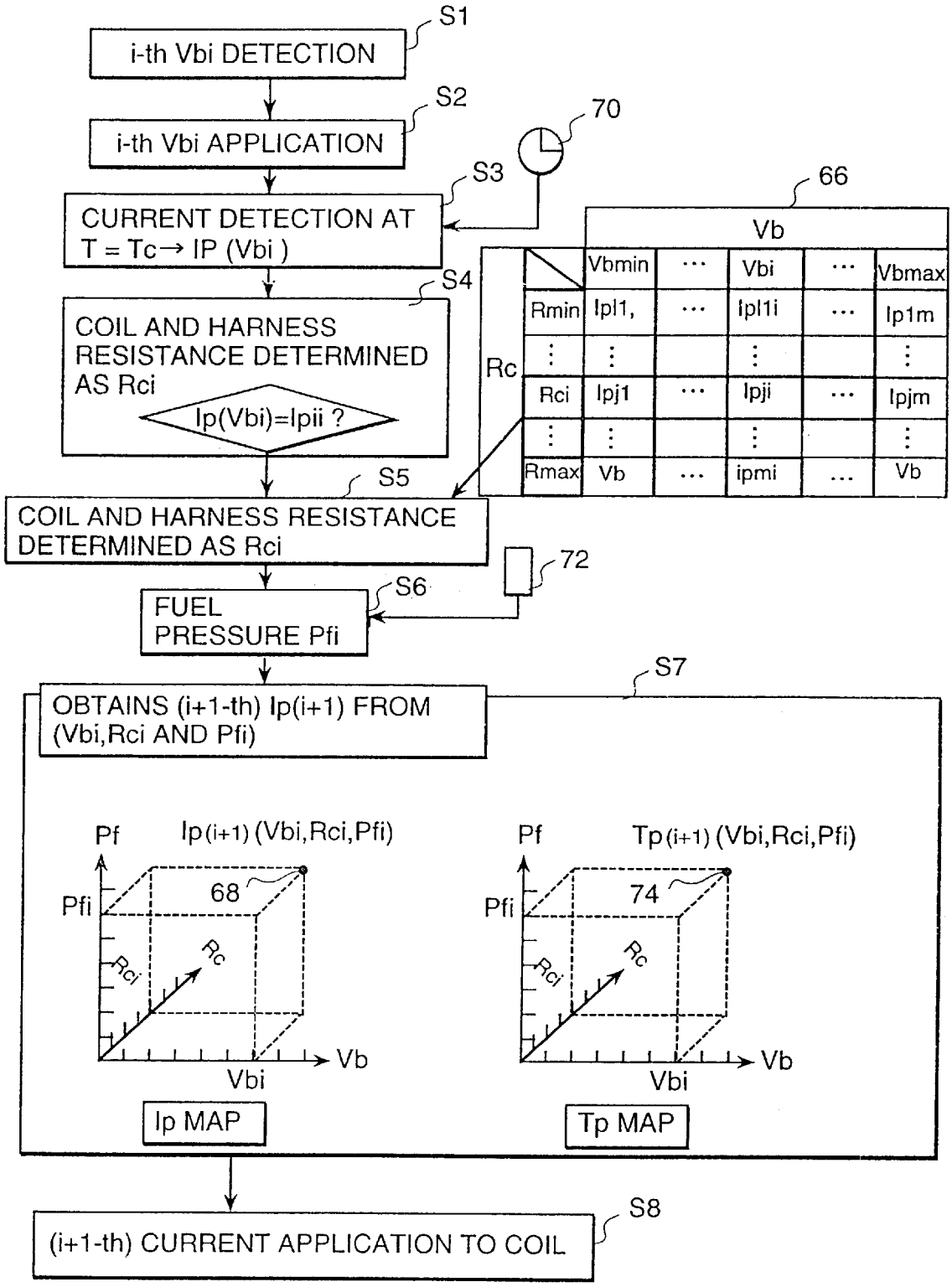
FIG. 5 is a flowchart illustrating the operation of the current switching controller.

The operation of the current switching control unit 60 will be described with reference to the flow chart in FIG. 5. This embodiment shows an example of how the target peak current value is obtained for every first drive of the injector valve 10 (an example of obtaining the target peak current value of the i+1-th injection from the detection result of the i-th injection). At first, the battery voltage Vbi prior to the i-th injection is detected (step S1). Then, for the i-th injection, the battery Voltage Vbi is applied to the coil 10 (step 2). Then clock signals coming from the timer 70 are measured. When measured time T is the same as the preset time Tc, the current Ip (Vbi) flowing to coil 20 is detected (step 3). Then, the data in the column of the battery voltages Vbi is sought from the current response value map at time Tc with respect to each battery voltage Vb and each resistance Rc stored in the resistance estimating unit 66 (step 4). Then, the resistance value Rci which becomes the current value Ipii closest to the coil current Ip (Vbi) is stored as the coil and harness resistance (step 5). After that, the output from the fuel pressure sensor 72 is captured and the fuel pressure Pfi of the i-th injection is detected (step 6).

The above processing allows the current state of the battery voltage Vbi, the resistance Rci and the fuel pressure Pfi in the i-th injection to be determined. These values are used as bases to seek the Ip map inside the resistance estimating unit 66 and to obtain, the i+1-th target peak current value Ip (i+1) (step-7). Then, the i+1-th coil current application is carried out based on the target peak current value Ip (i+1) (step 8).

As discussed above, repeating the steps S1 to S8 allows the injector valve 10 to be driven always at the optimum target peak current value.

When the injector 10 is driven according to target switching timing instead of target peak current value, the data on the Tp map of the target switching time storage unit 74 is sought to obtain the i+1-th target switching time (target switching timing) Tp (i+1), instead of obtaining the i+1-th target peak current value Ip (i+1) in step 7. Then, i+1-th coil current application is Performed based on the target switching time Tp (i+1).

The operation of the power transistor 50 is controlled by the current control circuit 56 in conformity to the target peak current value or target switching time (target switching timing) determined by the above processing. In this case, while the coil current detected by the current detecting resistor 52 is lower than the target peak current value, or the time measured by the switching timing determining unit 76 has not yet reached the target switching time, the power transistor 50 is kept turned on by ON-signals coming from the current control circuit 56, and the battery voltage is continuously applied to coil 20 to increase the level of current sent to the coil. When the current flowing to the coil has reached the peak current value, or when the time which has elapsed after the start of the current application has reached the target switching time, the power transistor 50 is deactivated. Then, the power transistor 50 repeats on-off operations to obtain a holding current which is lower than the coil current value at that time point, thereby maintaining the current to be sent to coil 120 at the holding current valve. In other words, the holding current required to hold the valve 42 open is supplied to the coil 20.

When the injection command pulse from the engine controller 58 falls, the current application to power transistor 50 is suspended by the current control circuit 56, thereby to terminate fuel injection by the injector valve 10. In this case, even if the coil current has not yet reached the target peak current, or the elapsed time has not yet reached the target switching time, the current application to the coil 20 terminates when the injection command pulse falls, and injection by the injector valve 10 terminates.

The following description relates to the drive method according to the present invention when the battery voltage, resistance and fuel pressure are set to the standard state. At the same, time, it the result of comparison between the drive method according to the present invention and a conventional drive method, when the battery voltage has dropped, when the coil and harness resistance has increased, and when fuel pressure (fuel pressure) has increased, will also be discussed.

<When Battery Voltage, Resistance and Fuel Pressure are Set to Normal States>

Figure 6A:
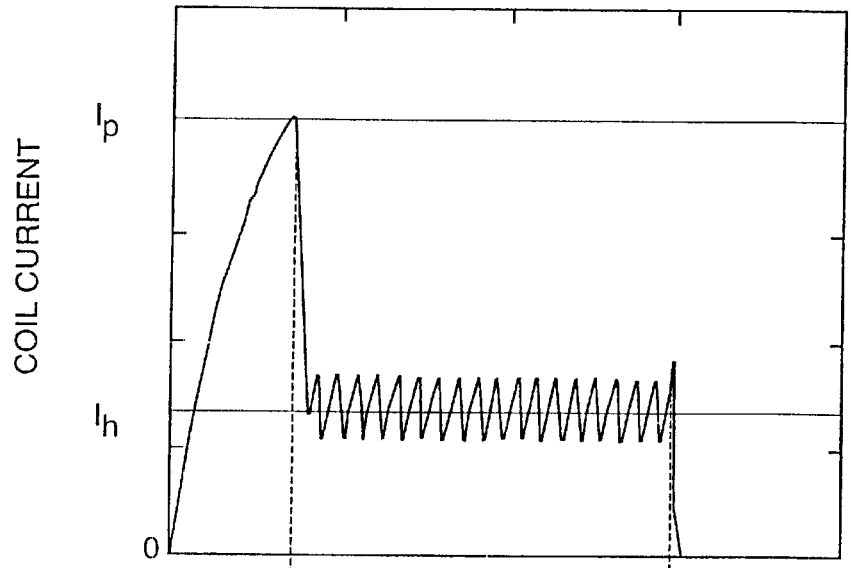
FIGS. 6(*a*) to 6(*c*) are diagrams showing the coil current, applied voltage and injection volume when the battery voltage resistance and fuel pressure are in the standard mode.
Figure 6B:
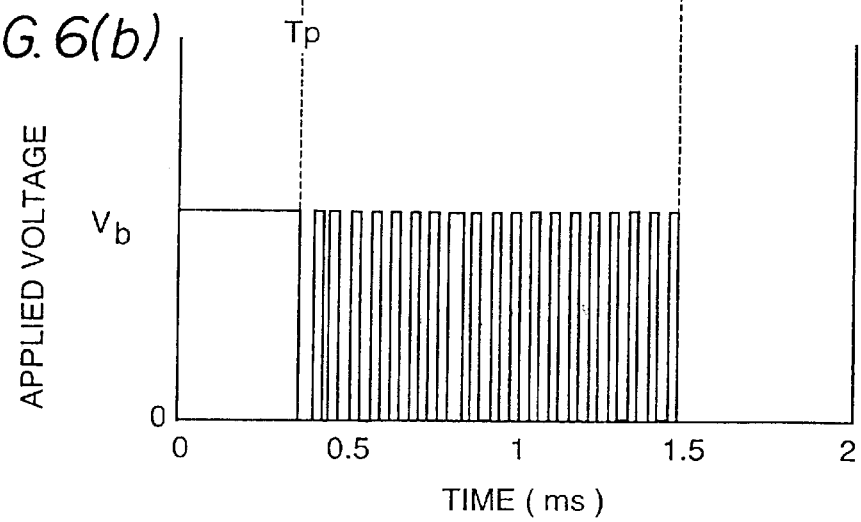
Figure 6C:
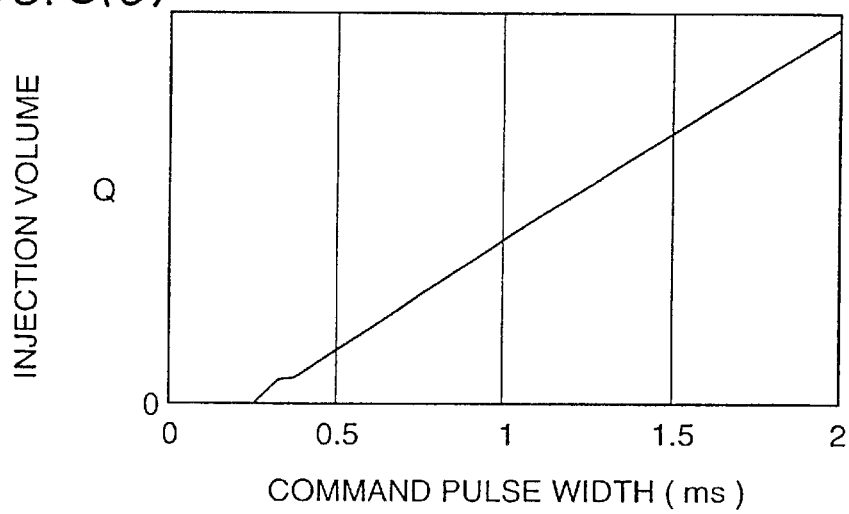

FIG. 6(*a*) is a current characteristic diagram representing an example of the operation of injector valve 10 when it receives an injection command pulse from the engine controller 58 having a width T of 1.5 ms. In this case, the target peak current value read from the target peak current storage unit 68 is Ip. In the initial phase of starting the current application, the power transistor 50 is kept turned on, and the battery voltage Vb is continuously applied to the coil 20. When the steeply increasing current flowing to the coil 20 has reached Ip under this condition, the power transistor 50 is turned off by a command from the comparator 62, and the voltage applied to the coil 20 is suspended. The time in this case is assumed to be Tp. This makes the coil current fall below Ip. In this case, the coil current is detected by the current detecting resistor 52. If coil current has fallen below the optimum current value Ih required to hold the valve 42 open, the power transistor 50 is turned on again, and on-off operation of the power transistor 50 is repeated. When this switching time has exceeded 1.5 ms and the injection command pulse has risen, the power transistor 50 also turns off, and the current application to coil 20 also terminates. This results in a damping of the magnetic attraction generated from the coil 20. The valve 42 is pressed against the seat surface 44 by the elasticity of return spring 36 (spring force) and the fuel pressure, and fuel injection terminates. In this case, the holding current used as the current of coil 20 is the optimum value Ih, so a short delay in valve closing can be realized.

FIG. 6(*c*) is a characteristic diagram showing the injection volume where the width Ti (ms) of the injection command pulse coming from the engine controller 58 is plotted on the horizontal axis, and injection volume in this case is shown on the vertical axis. When the valve is opened, the target peak current value is set to the optimum value Ip, and the holding current is set to the optimum value Ih. This makes it possible to realize the characteristics that the volume of injection exhibits a linear increase in conformity to the increase in the width of the injection command pulse when the valve is opened.

<When the Battery Voltage has Dropped>

Figure 7A:
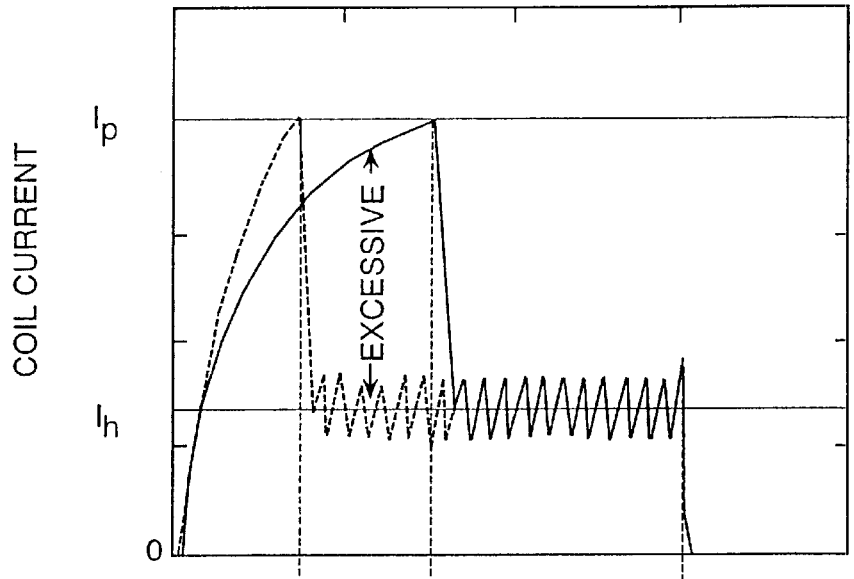
FIGS. 7(*a*) to 7(*c*) are characteristic diagrams showing the drive conditions according to the conventional method at a low battery voltage.
Figure 7B:
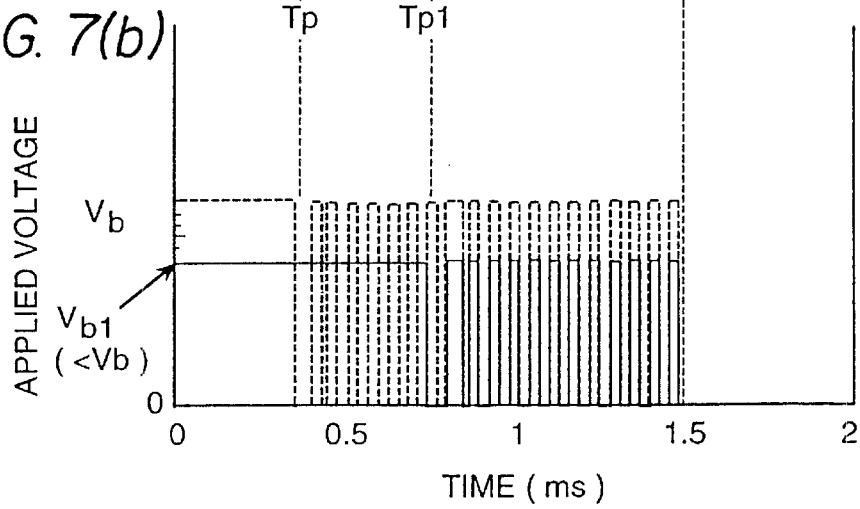
Figure 7C:
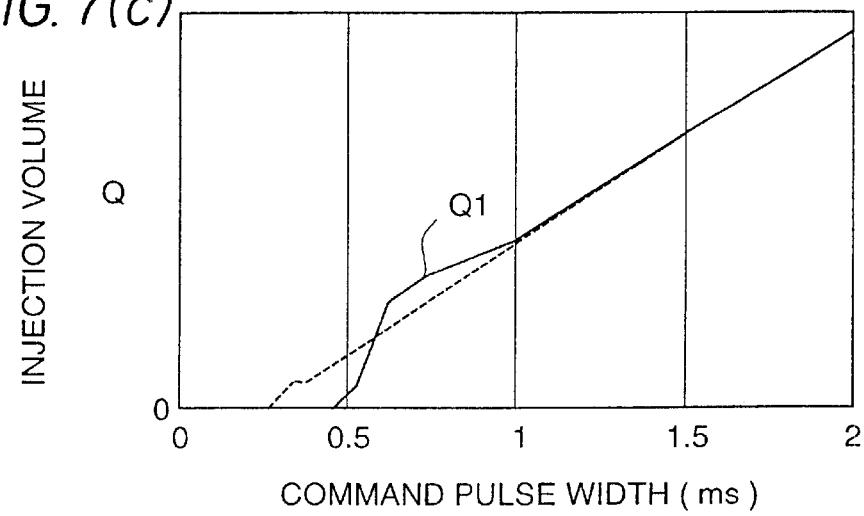

FIGS. 7(*a*) and (*b*) are characteristic diagrams showing changes in coil current and applied voltage when the target current Ip is kept unchanged, even if the battery voltage has dropped, with the resistance and the fuel pressure kept unchanged from the state of FIGS. 6(*a*) and 6(*c*).

The rise of the coil current is less sharp when the battery voltage has been reduced from Vb to Vb1, as seen in FIGS. 7(*a*) and (*b*). This results in the coil current reaching Ip much later than Tp, at Tp1. Then, the application of battery voltage Vb1 is suspended temporarily, and this makes the coil current fall below Ip. The current is detected by the current detecting resistor 52, and when the coil current is reduced below the current value appropriate to hold the valve 42 open, the power transistor 50 is turned on again, and the coil current value is Ih after that. In order to realize this, the switching operation of the power transistor 50 is controlled of to repeat alternately the process of applying voltage Vb1 to coil 20 and the process of suspending it.

FIG. 7(*c*) is a characteristic diagram showing the injection volume where the width Ti (ms) of the injection command pulse.coming from the engine controller 58 is plotted on the horizontal axis, and the injection volume with the battery voltage reduced to Vb1 is shown on the vertical axis. As shown in FIG. 7(*a*), a drop in the battery voltage results in a later rise of the coil current and a delay of the valve opening time. This also delays the rise of the injection volume, as shown in FIG. 7(*c*). So, when the valve is opened, the pressure is balanced on both sides of the valve 42, and the force applied to the valve 42 is reduced, as discussed earlier. As shown in FIGS. 6(*a*) to 6(*c*), if the battery voltage is not reduced, the current value becomes the holding current Ih immediately. If the battery voltage is low, however, the current application time is Tp1 or more. If it is Tp1 or less, the current value I continues to rise in the form of Ih<I<Ip. So, the magnetic attraction is excessive when compared to the case of I=Ih. As a result, the current application is stopped if the injection pulse rises under these conditions. However, the delay in valve closing will be increased by the excessive magnetic attraction.

Characteristics of the injection volume in this case are reflected by the command pulse width of 0.5 ms to 1 ms. Before time Tp1 is reached, there is a bigger delay in valve closing than when the battery voltage is normal, and the valve opening time is prolonged. As a result, the valve opening time with respect to the same pulse width becomes longer than when the battery voltage is normal (at rated voltage), and injection volume during this time increases with the result that a convex upward characteristic curve appears. This characteristic deteriorates the linearity, and the minimum injection volume increases in the controllable range. Application of the system to a low fuel engine will be difficult in this case. A further drop of battery voltage will result in the coil current being unable to reach Ip in the maximum injection command pulse width, with the result that the appropriate current value Ih required to keep the valve open cannot be attained. Current application may terminate if the current is kept high. If this occurs, there will be a substantial deterioration in the linearity of the injection volume. Furthermore, a modestly high current may be applied for a long time, and heat generation or burnout may occur.

Figure 8A:
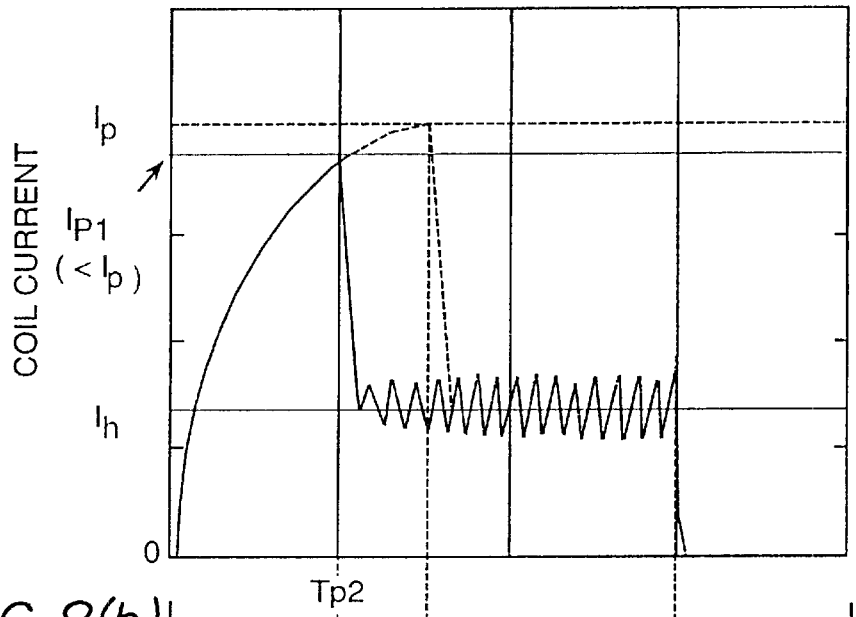
FIGS. 8(*a*) to 8(*c*) are characteristic diagrams showing the injection drive conditions at a low battery voltage by the drive method according to the present invention.
Figure 8B:
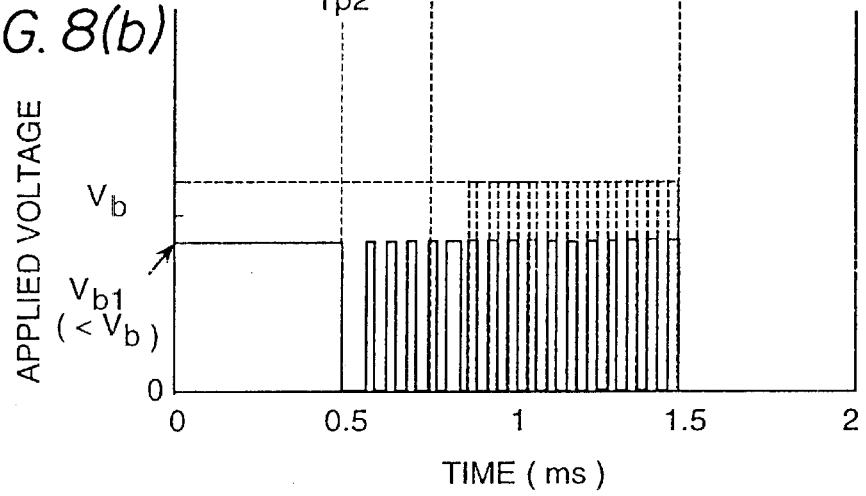
Figure 8C:
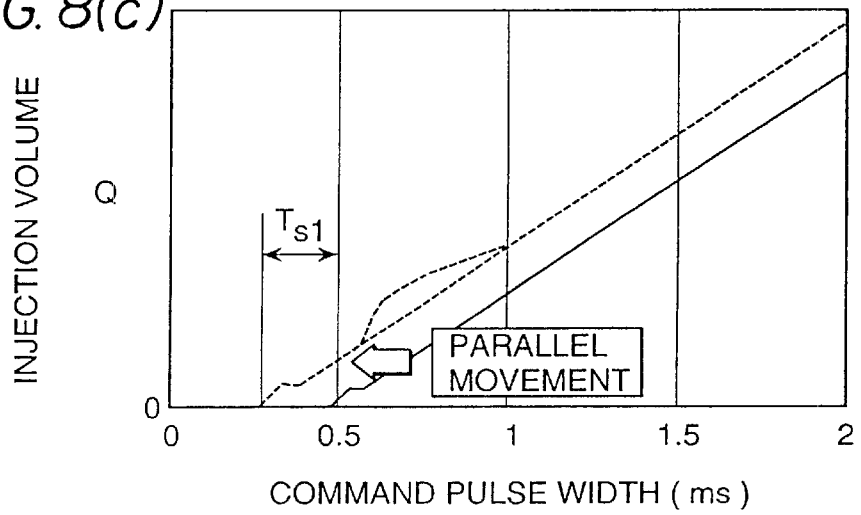

By contrast, FIGS. 8(*a*) to 8(*c*) show characteristic diagrams where a low value is selected as a target peak current value in conformity to the drop of battery voltage when the battery voltage has dropped.

According to the present embodiment, the time before the coil current reaches the target peak current value can be assumed as Tp2 by setting the target peak current to the value Ip1 (<Ip) optimum to battery voltage Vb1 (<Vb) in the event of a battery voltage drop, as shown in FIGS. 8(*a*) and 8(*b*). At the same time, this ensures an early transfer of coil current to current value Ih appropriate to holding the valve 42 open. Furthermore, the optimum peak current Ip1 (target peak current) for this battery voltage Vb1 may be obtained either on an experimental basis by injector characteristics test or by simulation.

In the present embodiment, the target peak current value in opening the valve is set to the optimum value Ip1, and the holding current is set to the optimum value Ih. This makes it possible to implement the characteristics whereby the injection volume is linearly increased in conformity to the increase in the width of the injection command pulse when the valve is opened.

When fuel is injected according to the characteristics shown by the solid line of FIG. 8(*c*), a delay in valve opening may result from drop of the battery voltage. According to the present embodiment, offset Ts1 is added to the pulse width Ti to compensate for the injection command pulse width Ti in the event of a drop in the battery voltage. Optimization of the injection volume characteristics can be ensured by a current application in response to the injection command pulse having the compensated pulse width. For example, if the width of the required injection command pulse from the engine controller 58 is Ti0 ms, the current application time is compensated as (Ti0×Ts1) ms. This makes it possible to keep the injection volume characteristics which will result in the optimum linearity, while the impact of the drop in battery voltage is minimized.

<When the Coil and Harness Resistance has Increased>

Figure 9A:
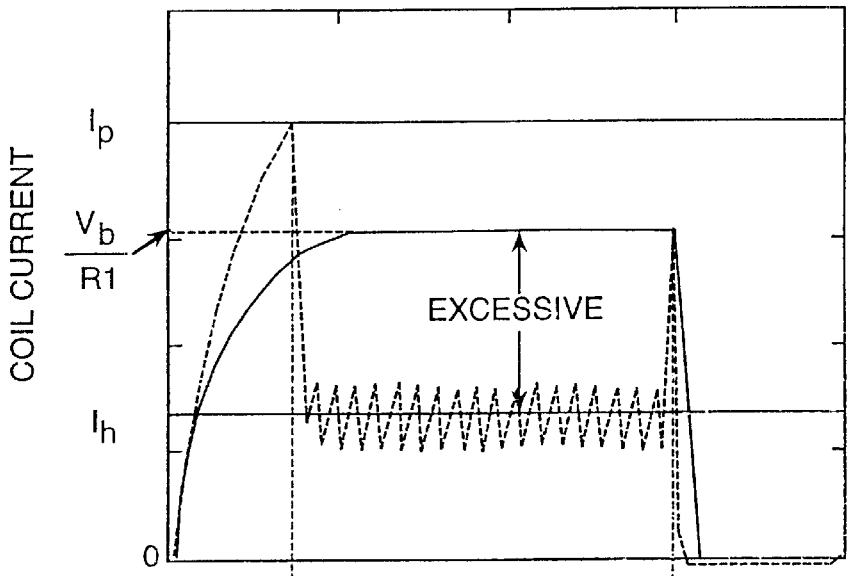
FIGS. 9(*a*) to 9(*c*) are characteristic diagrams showing the drive conditions according to the conventional method at an increasing coil/harness resistance.
Figure 9B:
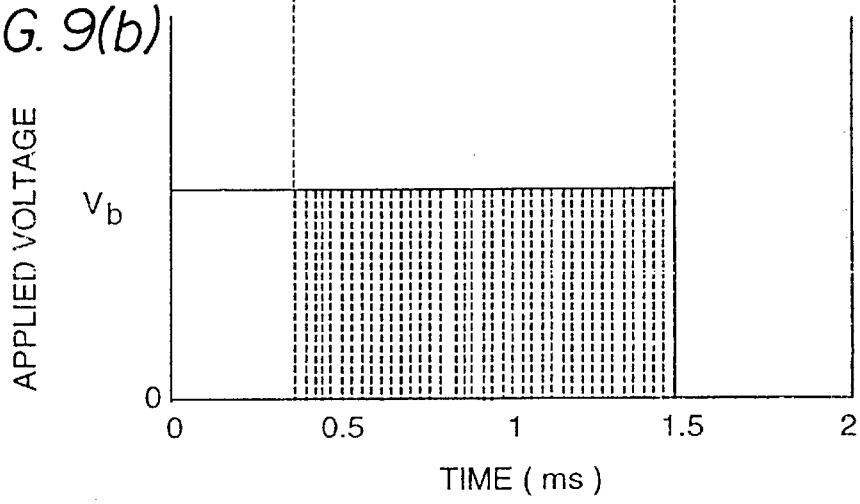
Figure 9C:
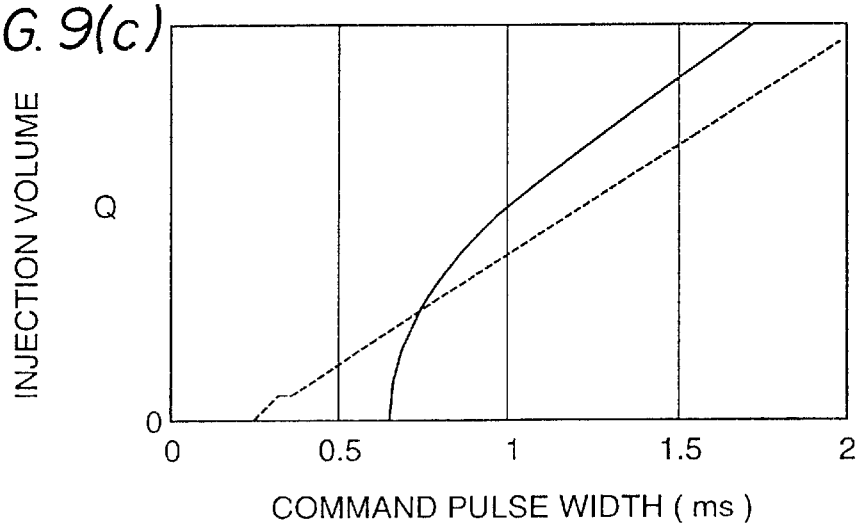

FIGS. 9(*a*) and 9(*b*) show the characteristics of the coil current and applied voltage in driving the coil 20 with the target peak current Ip kept under the same condition as FIGS. 6(*a*) to 6(*c*), when the coil and harness resistance has increased, with the battery voltage and fuel pressure kept unchanged from the standard state shown in FIGS. 6(*a*) to 6(*c*).

When resistance has increased to reach R1, the rise of the current flowing to the coil 20 is reduced, as seen in FIG. 9(*a*). This is because the convergent value is reduced, although the time constant of the electric circuit formed in the coil and harness is improved. In FIG. 9(*a*), the value of Vb/R1 cannot reach Ip, even if the battery voltage Vb is applied over the entire width Ti (here 1.5 ms) of the command injection pulse. Without reaching the optimum holding current Ih, the coil current value becomes Vb/Ri (>Ih) over the width Ti (here 1.5 ms) of the command injection pulse.

FIG. 9(*c*) is a characteristic diagram showing the injection volume where the width Ti (ms) of the injection command pulse coming from the engine controller 58 is plotted on the horizontal axis, and the injection volume with the resistance increased to R1 is shown on the vertical axis. As shown in FIG. 9(*a*), the margin for coil current rise is reduced, and the valve opening time is delayed. This delays the rise of the injection volume, as shown in FIG. 9(*c*). So when the valve is opened, the pressure is balanced on both sides of the valve 42, and the force applied to valve 42 is reduced, as discussed earlier.

As shown in FIGS. 6(*a*) to 6(*c*), if the resistance is not increased, the current value reaches holding current value Ih immediately. If the resistance is increased, however, the coil current I continuously flows in the state of Ih<1=Vb/Rh 21 Ip. In this state, it is excessive as compared with the case of the magnetic attraction of coil 20 being I=Ih. As a result, current application is stopped if the injection pulse falls. However, the delay in valve closing will be increased by the excessive magnetic attraction. This phenomenon is reflected in the volume injection shown in FIG. 9(*c*). In other words, the increase in the resistance results in the closing of the valve being delayed by an excessive attraction due to excessive current. A longer valve opening time is required than when resistance is normal. As a result, the valve opening time for one and the same pulse width is longer than when the battery voltage is normal (at rated voltage). The injection volume is increased, with the result that a convex upward characteristic curve appears. At the same time, an abrupt rise characteristic for the pulse width appears. This characteristic deteriorates the linearity, and the minimum injection volume increases in the controllable range, with the result that application of the system to a low fuel engine will be difficult. Furthermore, under this condition, the coil current cannot reach the target peak current value Ip for the width of the maximum injection command pulse, and the optimum current value Ih to hold the valve 42 is not obtained. The application of current terminates at a high current. Furthermore, heat generation or burnout, may occur due to long-time current application at a modestly high current.

Figure 10A:
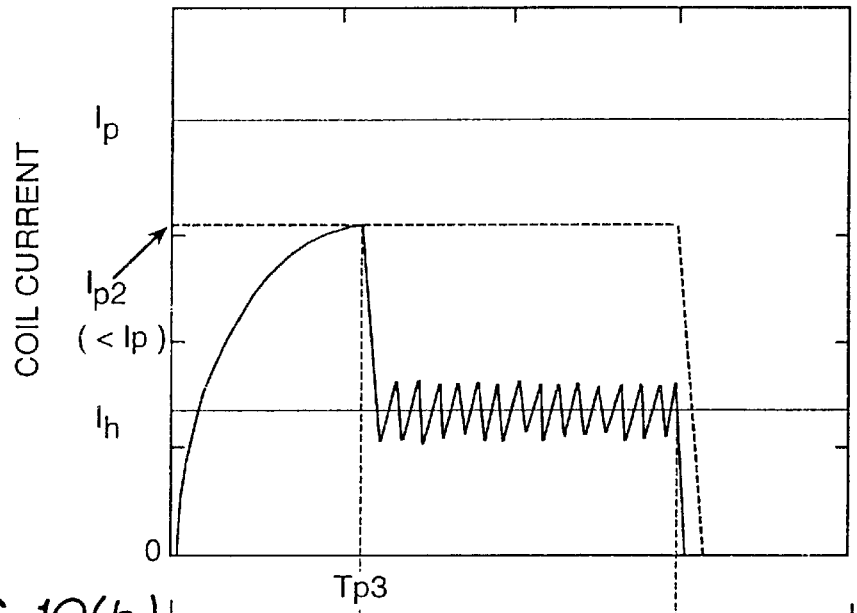
FIGS. 10(*a*) to 10(*c*) are characteristic diagrams showing the drive conditions according to the present invention at an increasing coil/harness resistance.
Figure 10B:
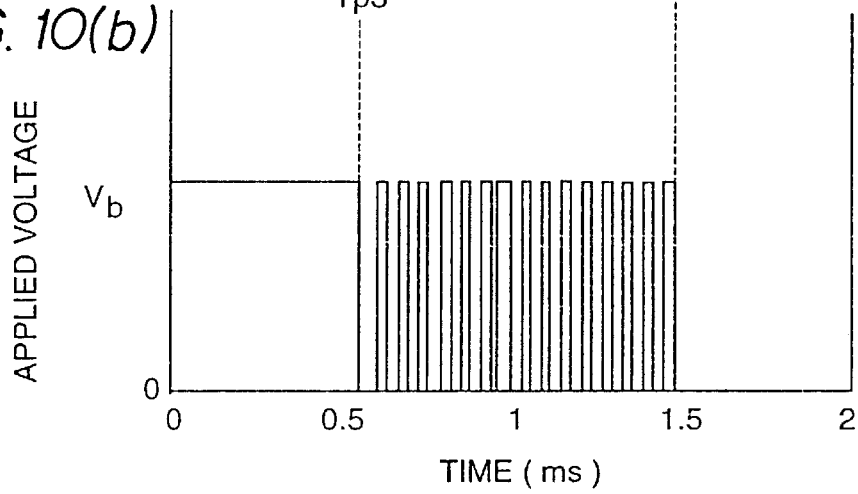
Figure 10C:
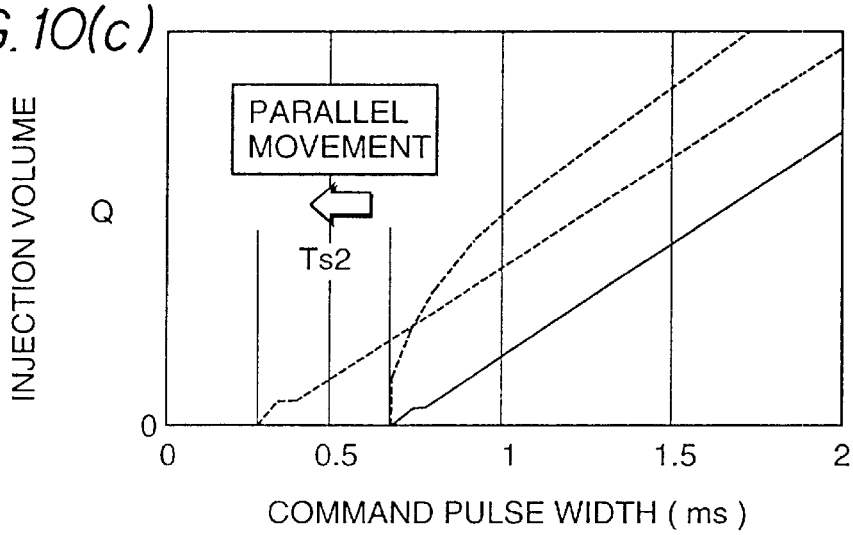

FIGS. 10(*a*) to 10(*c*) show the characteristics when a low target peak current value is selected in conformity to a resistance increase when there is an increase of resistance.

According to the present embodiment, the target peak current is set to value Ip2 (<Ip) which is optimum to the resistance R1 when the resistance has increased, as shown in. FIG. 10(*a*). This makes it possible to ensure that the time for the coil current to reach the target peak current value is Tp3. This ensures an early transfer of the holding current required to hold the valve 42 to the current value Ih. The optimum peak current Ip2 (target peak current value) for this resistance R may be obtained either on an experimental basis by injector characteristics test or by simulation.

According to the present embodiment, the target peak current value is set to the optimum value Ip when the valve is open. Since the holding current is set to the optimum value Ih, it is possible to realize characteristics which result in a linear increase of injection volume in conformity to an increase in the width of the injection command pulse when the valve is open.

When fuel is injected from the injector 10 according to the injection volume characteristics shown by the solid line in FIG. 10(*c*), a delay may occur in the valve opening due to an increase in the resistance. In this case, an offset Ts2 is added to the pulse width Ti to compensate for the width Ti of the injection command pulse, thereby changing the injection volume characteristics from the characteristics indicated by the solid line to those indicated by broken lines. If the width of the injection command pulse required by the engine controller 58 is Ti0 ms, for example, it is possible to realize injection volume characteristics which exhibit a minimum impact from the increased resistance by correcting the current application time to (Ti0+Ts2) m8.

Figures 11A, 11B:
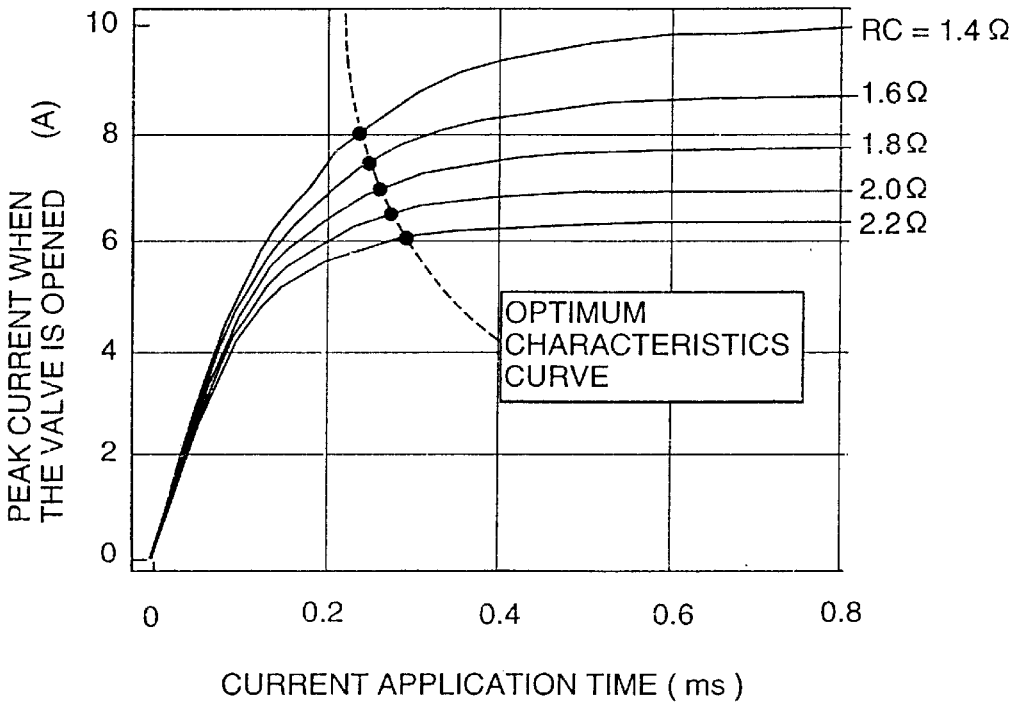
FIG. 11A is a diagram illustrating the relationship between the resistance and coil current.
FIG. 11B is a table of the target peak current value and arrival time.

FIG. 11A shows the relationship between the coil and harness resistance and coil current response when the battery volume and fuel pressure are set at desired values. From this, it is apparent that an increase in the coil and harness resistance results in a decrease of the current convergent value. A dotted line in the FIG. 11A denotes the curve where the injection volume characteristics are made optimum. This curve may be obtained either on an experimental basis or by simulation. The crossing point between this optimum current and the current response is the optimum target peak current value for each of the coil and harness resistances.

FIG. 11B tabulates this relationship. The data is stored in the target peak current storage unit 68 and target switching time storage unit 74. The optimum target peak current value can be uniquely determined by specifying the battery voltage and current application. This relationship is stored in the target switching time storage unit 74 as the data on target switching time. The data of the target peak current table shown in FIG. 11B is given as a value which decreases in the direction in which resistance increases. The peak arrival time (target switching time) is given as a value which increases in the direction in which resistance increases. In this way, injection volume characteristics can be improved by decreasing the target peak current or by delaying the target switching time when coil the and harness resistance has increased, based on the data stored in the Table.

<When Fuel Pressure has Increased>

Figure 12A:
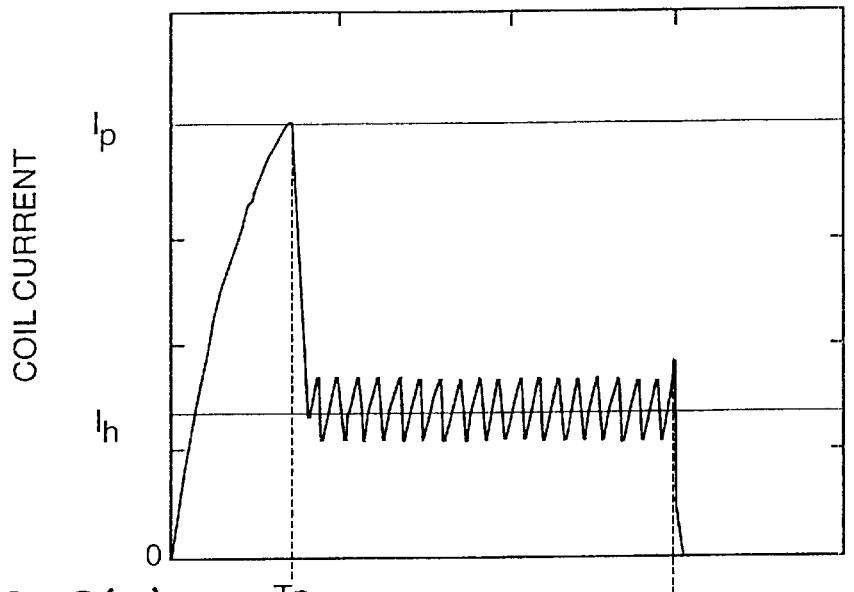
FIGS. 12(*a*) to 12(*c*) are characteristic diagrams showing the drive conditions according to the conventional method at an increasing fuel pressure.
Figure 12B:
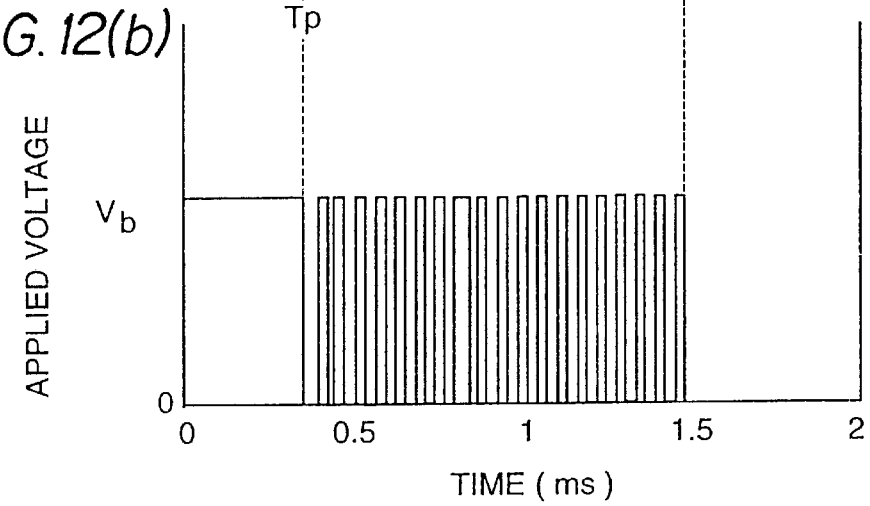
Figure 12C:
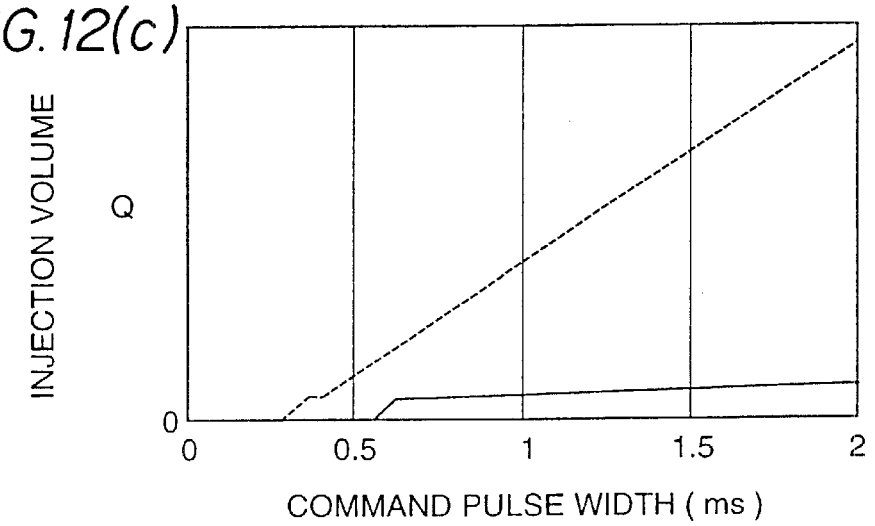

FIGS. 12(*a*) and 12(*b*) are characteristic diagrams showing the characteristics of the coil current and applied voltage in driving the coil 20 with the target current Ip kept in the same state as FIGS. 6(*a*) and 6(*b*), when the fuel pressure supplied to the injector valve 10 is increased to reach Pf1, with the battery voltage and resistance unchanged from the state of FIGS. 6(*a*) and 6(*b*). Even when the fuel pressure has increased, the electric circuit does not change with respect to the battery voltage and coil/harness resistance, if the target current Ip is kept unchanged. So the current waveform and magnetic attraction to be generated stay unchanged from the state of FIGS. 6(*a*) and 6(*b*). However, the force applied to the valve 42 is increased by the fuel pressure, so the valve 42 is closed immediately although it opens slightly.

FIG. 12 (*c*) is a characteristic diagram showing the injection volume where the width Ti (ms) of the injection command pulse coming from the engine controller 58 is plotted on the horizontal axis, and the injection volume with increased fuel pressure is shown on the vertical axis. The injection volume characteristics shown in FIG. 6(*c*) denote a constant value with respect to the width Ti of the injection command pulse. This shows that the valve cannot be opened despite a prolonged current application time after the valve 42 has closed subsequent to opening. It is impossible to control the injection volume in terms of current application. In other words, according to the peak hold method, similar to the conventional method, the valve does not open in the event of increased fuel pressure, and the injection volume cannot be controlled by the current application time.

Figure 13A:
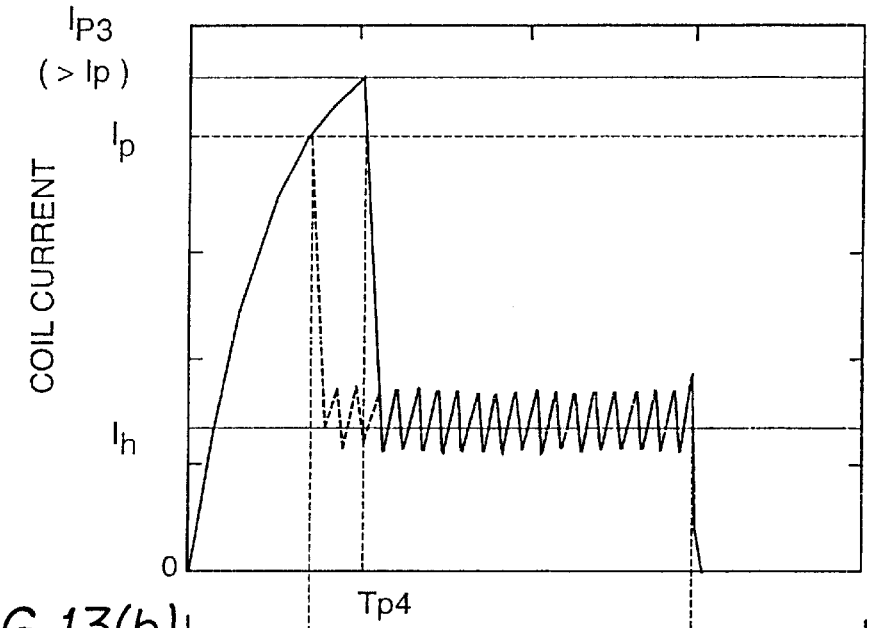
FIGS. 13(*a*) to 13(*c*) are characteristic diagrams showing the drive conditions according to the present invention at an increasing fuel pressure.
Figure 13B:
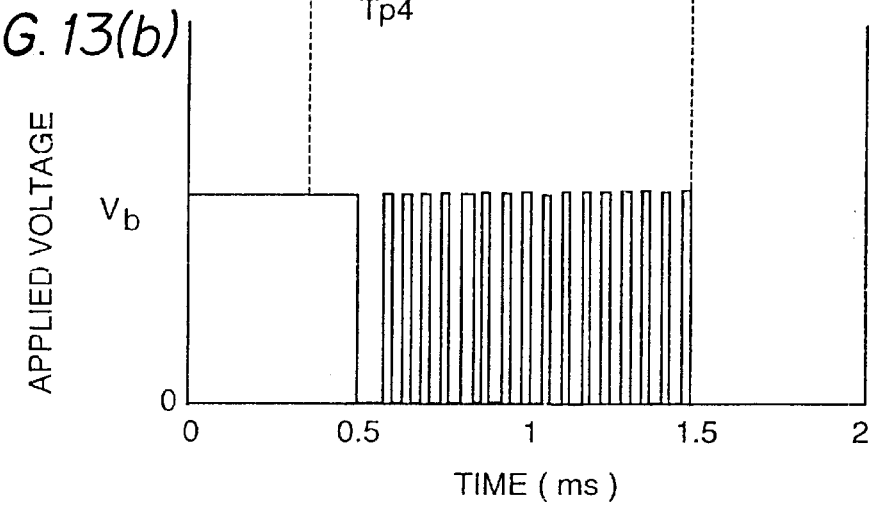
Figure 13C:
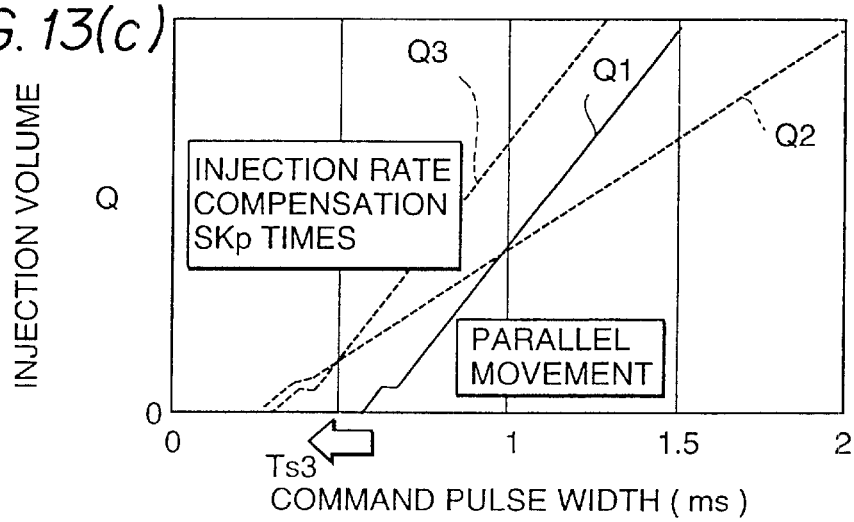

In contrast, FIGS. 13(*l*) to 13(*c*) show the characteristic results obtained when the fuel pressure is increased and the target peak current value is increased in conformity to the increased fuel pressure.

According to the present embodiment, the valve can be opened by changing the target peak current to the value Ip3 (>Ip), which optimum to the fuel pressure Pf1 in the event of increased fuel pressure, as shown in FIG. 13(*a*). The optimum peak current Ip3 with respect to this fuel pressure Pf1 may be obtained either on an experimental basis by injector test or by simulation.

In the present embodiment, the target peak current value when the valve 42 is open is set to the optimum value Ip3 and the holding current is set to Ih. This makes it possible to realize characteristics which result in the injection volume being linearly increased in conformity to an increase in the width Ti of the injection command pulse, when the valve is open.

According to the present embodiment, the adoption of the above discussed drive method allows the fuel to be injected according to the injection volume characteristics Q1 indicated by the solid line in FIG. 13(*c*). However, the injection of fuel according to injection volume characteristics indicated by the solid line may, cause a delay in the opening of the valve 42 in conformity to the increased fuel pressure. In this case, offset Ts3 is added to the pulse width Ti to correct the pulse width Ti, and the current is applied to coil 20 according to the corrected injection command pulse to compensate for the injection rate. This makes it possible to inject fuel according to the optimum injection volume, characteristics as shown by characteristic Q3. For example, when the width of the injection command pulse required by the engine controller 58 is Ti0 ms, the current application time is corrected to (Ti0+Ts3) ms, and this corrected current application time is divided by √Kp of the magnification of the reference fuel pressure. In other words, it is possible to realize the injection volume characteristics with the minimum impact of increased fuel pressure by correcting the current application time to (Ti0+Ts3)√Kp, as shown by characteristic Q3 in FIG. 13(*c*).

Figures 14A, 14B:
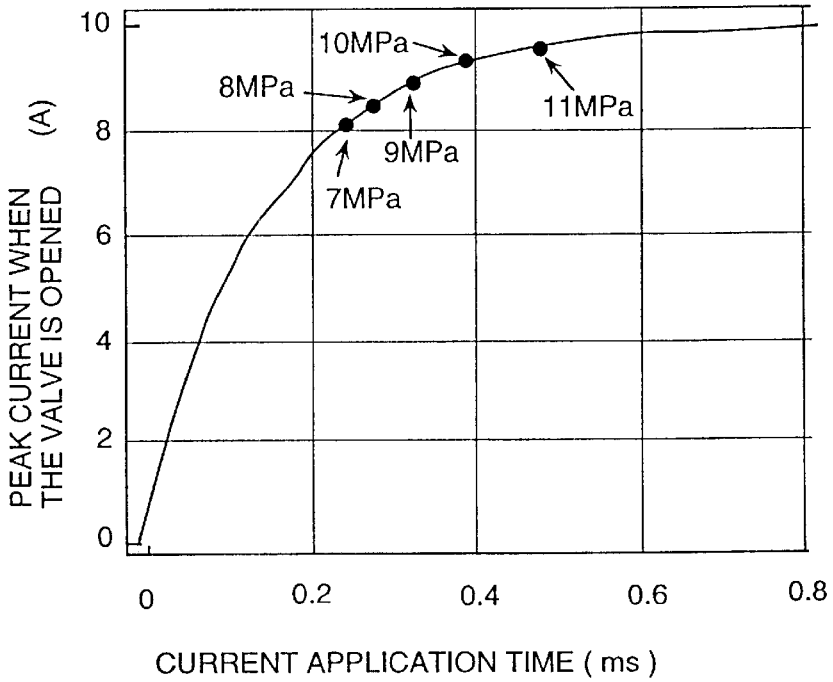
FIG. 14A is a diagram illustrating the relationship between the coil current and each optimum fuel pressure point.
FIG. 14B is a table of the target peak current value and time table.

Characteristics given in FIGS. 14A and 14B are taken into account when setting the target peak current value and peak arrival time (target switching time) in conformity to increased fuel pressure.

FIG. 14(*a*) shows that the current value which optimizes injection volume characteristics in each fuel pressure is plotted on the current response where the battery voltage and coil/harness resistance are set at desired values. Each point may be obtained either on an experimental basis or by simulation. Each point serves as the optimum target peak current value for each fuel pressure. FIG. 14(*b*) tabulates the relationship shown in FIG. 14(*a*). Furthermore, the optimum target peak current value can be determined uniquely by specifying the battery voltage and current application time. When this is used, the data related to this table will be stored in the target switching time storage unit 74. As shown in FIG. 14(*b*), the values which increase in the direction of increasing fuel pressure are assigned as the data stored in the target peak current table. The values which increase in the direction of increasing fuel pressure are also assigned as the data on peak arrival time (target switching time).

In this way according to the present embodiment, the injection volume characteristics can be improved by increasing the target peak current value or by delaying the target switching time when there is an increase in the fuel pressure.

In the present embodiment, "Ih" is assumed to be a holding current without any change with respect to the rise of the fuel pressure; however, it can be changed with respect to the rise of the fuel pressure.

Reference has been made to examples where each of the battery voltage, the resistance and fuel pressure is changed in the said embodiment. An abrupt change is considered to be made to fuel pressure and battery voltage in the normal operation mode. For fuel pressure, by way of an example, there is a variable fuel pressure system with respect to engine speed, load conditions and the like. Normally, there are cases where an abrupt change of the battery voltage is caused by an abrupt change of electric loads.

Figure 15A:
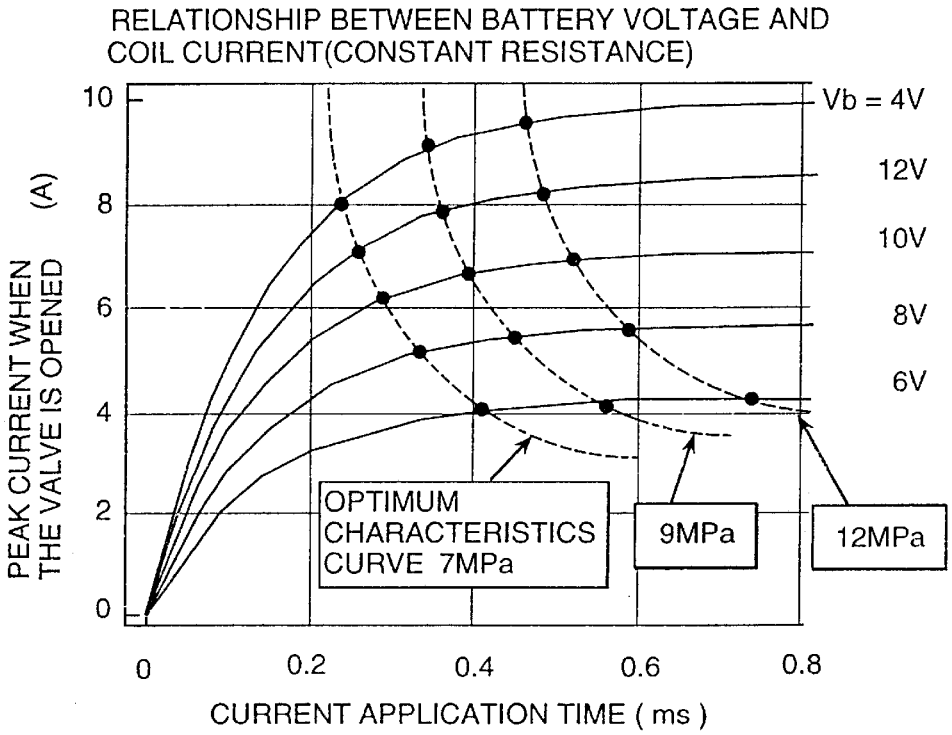
FIG. 15A is a diagram illustrating the relationship between the battery voltage and each optimum fuel pressure point.

FIG. 15A shows the map relationship of the target peak current value and target switching time with respect to the each battery voltage and fuel pressure from 7 MPa (Megapascal) to 12 MPa, where the resistance is kept constant and the battery voltage changes from 6 to 14 volts. The optimum points of each fuel pressure for each voltage are plotted and are connected for each fuel pressure valve to get the optimum curve for the injection volume characteristics for each fuel pressure. Each point may be obtained either on an experimental basis or by simulation. The map of FIG. 15B is a two-dimensional map for the battery voltage and fuel pressure. If this map is stacked for each resistance, a three-dimensional target IP map and target IP map are obtained.

Figure 16A:
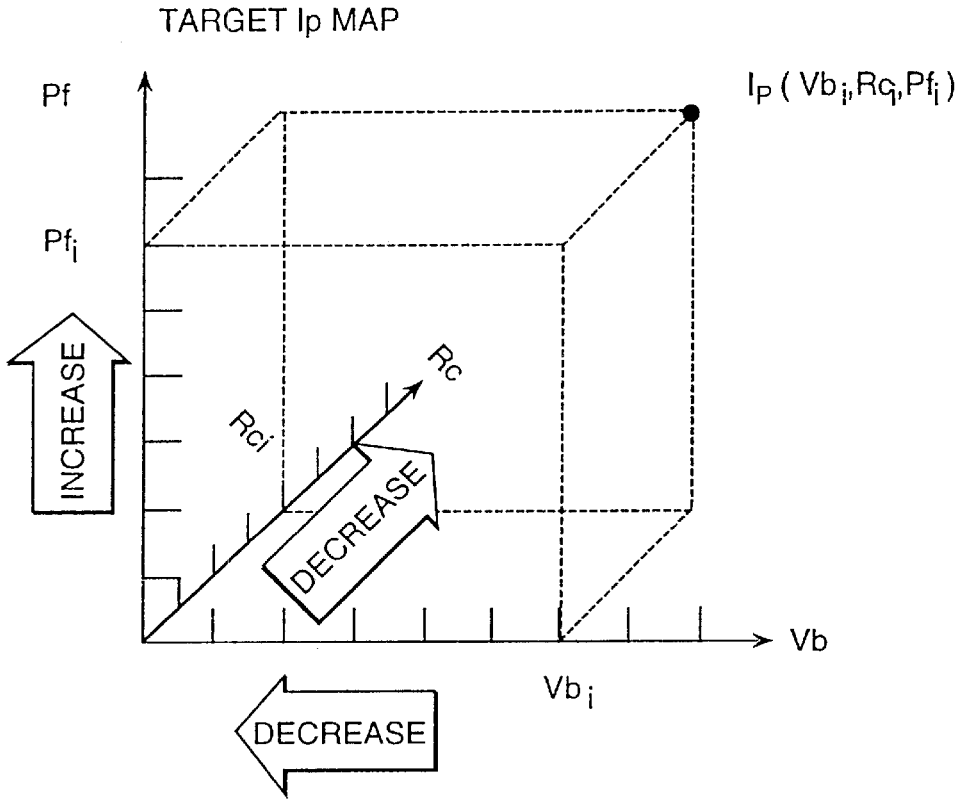
FIGS. 16A and 16B are diagrams illustrating the concepts of target Ip map and target Tp map, respectively.
Figure 16B:
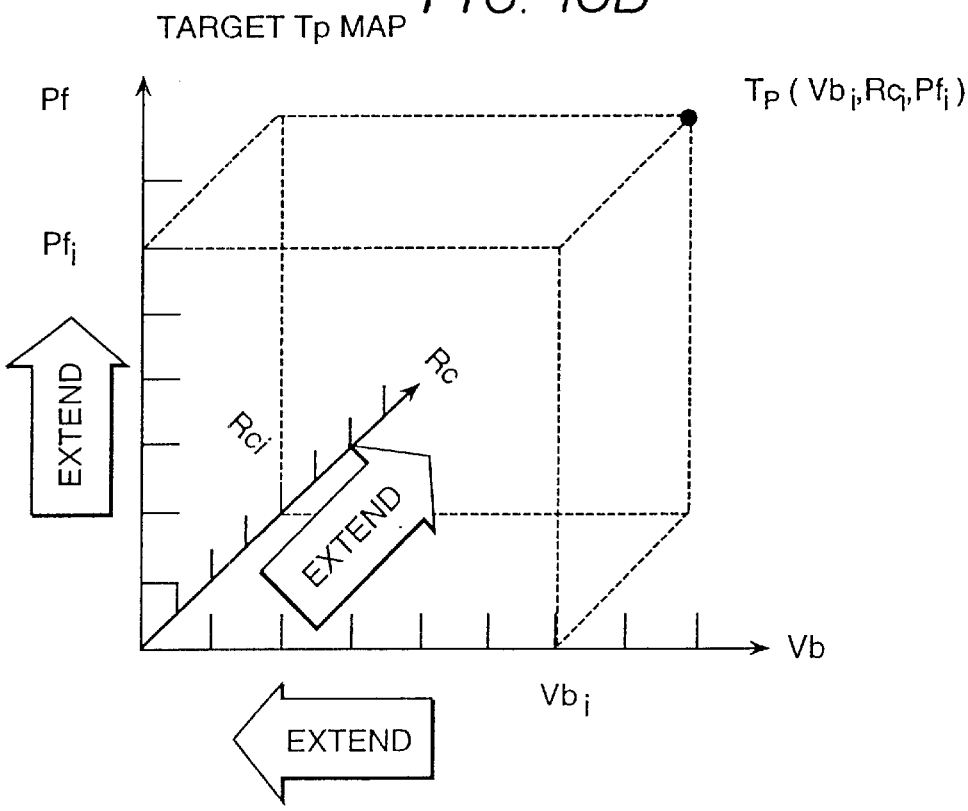

FIG. 16A is a conceptual diagram representing the target Ip map, and FIG. 16B is a conceptual diagram representing the target Tp map. The target Ip map and the target Tp map are 3D maps based on three augments: battery voltage, coil/harness resistance and fuel pressure.

If the numerical values stored in the target I map in FIG. 16A are made to correspond to one another for each axis, the data is stored in the target peak current storage unit 68 in the following directions: in the direction of decreasing target peak current for decreasing battery voltage, in the direction of decreasing target peak current for increasing resistance, and in the direction of increasing target peak current for increasing fuel pressure.

If the numerical values stored in the target Tp map in FIG. 16B are made to correspond to one another for each axis, the data is stored in the target switching time storage unit 14 in the following directions: in the direction of prolonged target switching time for decreasing battery voltage Vb, in the direction of prolonged target switching time for increasing resistance, and in the direction of prolonged target switching time for increasing fuel pressure.

Figure 17A:
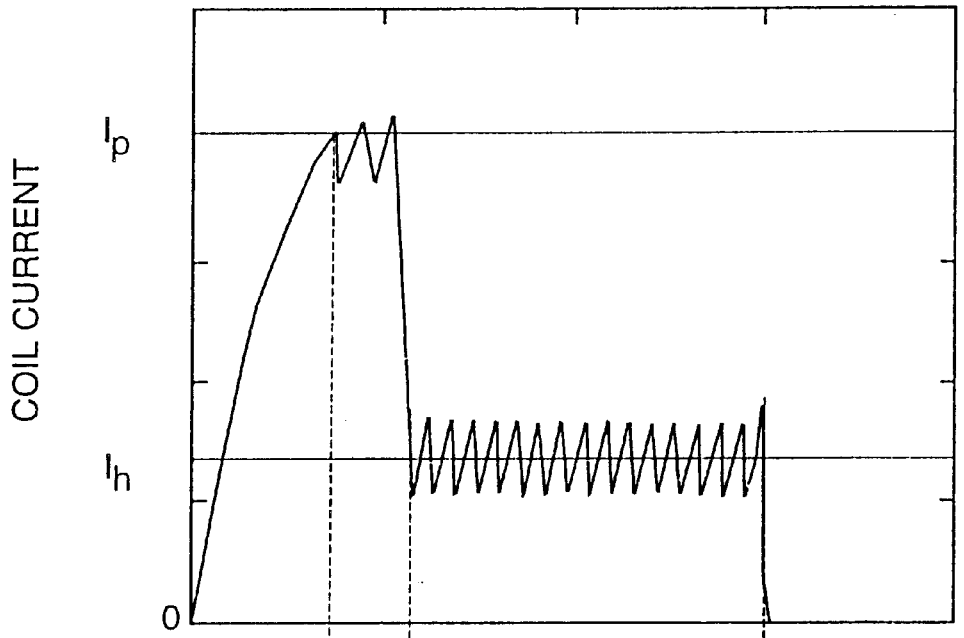
FIGS. 17(*a*) and 17(*b*) are characteristic diagrams illustrating the injector drive method when holding the peak current.
Figure 17B:
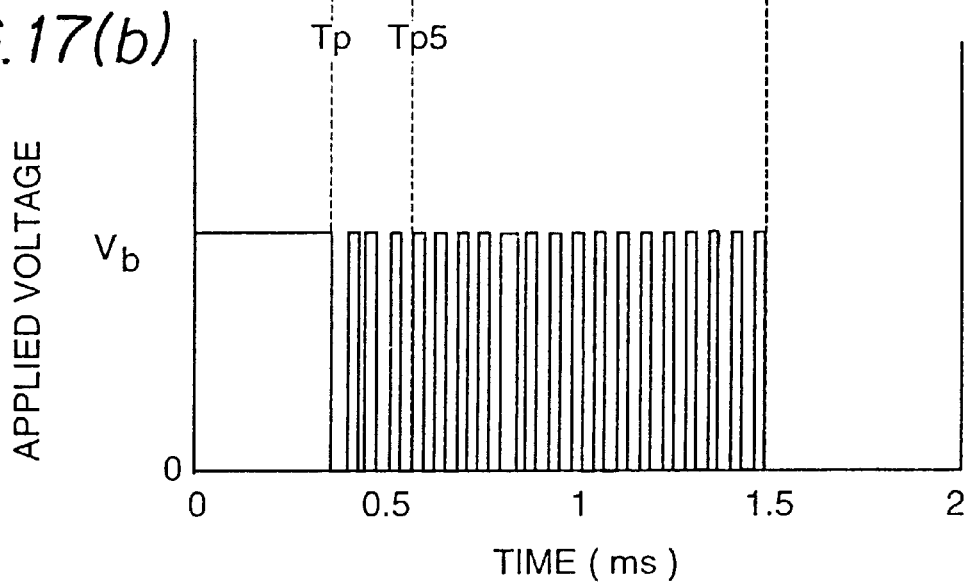

FIGS. 17(*a*) and 17(*b*) are characteristic diagrams showing the drive method where switching is performed at peak current value Ip when the valve is opened, and the peak current is held thereafter. The present invention can also be applied to such a drive method. In this case, the time Tp5 to release the holding of the target peak current value Ip, in addition to the target peak current value Ip, is also stored. The value is switched to ensure the value optimum to the changes of battery voltage, resistance and fuel pressure. This optimum value may be obtained either on an experimental basis or by simulation. Judging from the settings of the above-mentioned Ip map and Tp map, the time Tp5 to release the holding of these volumes will be stored in terms of numerical values which are set in the direction of prolonged time for decreasing battery voltage, in the direction of prolonged time for increasing resistance, and in the direction of prolonged time for increasing fuel pressure.

The above description relates to the method for searching the Ip map and the Tp map when seeking the target peak current value and the target switching time in conformity to battery voltage and fuel pressure in each of the above-mentioned embodiments. If the map contents are highly monotonous without a reverse point or singular point, a dimension of the map can be omitted, or compensation by interpolation or mathematical expression can be used.

In each of said embodiments, the above describes the case of using a single battery 18 as the power supply. When multiple batteries with significant different voltages, for example, 42-volt and 14-volt batteries, are installed, it is also possible to provide a selection circuit to select between each battery and coil 20, and apply a voltage from the high-voltage, battery (42 volts) to coil 20 in the initial stage of valve opening, and a current from low-volume battery (14 volts) to the coil 20 when a holding current is to be fed to the coil 20. In this case, the voltage of the high-voltage battery (42 volts) is monitored by the current switching control unit 60. In the event of this voltage, the target peak current value is reduced or the target switching time is prolonged. Through this process, it is possible to gain similar effects as those of the described embodiments.

Figure 18:
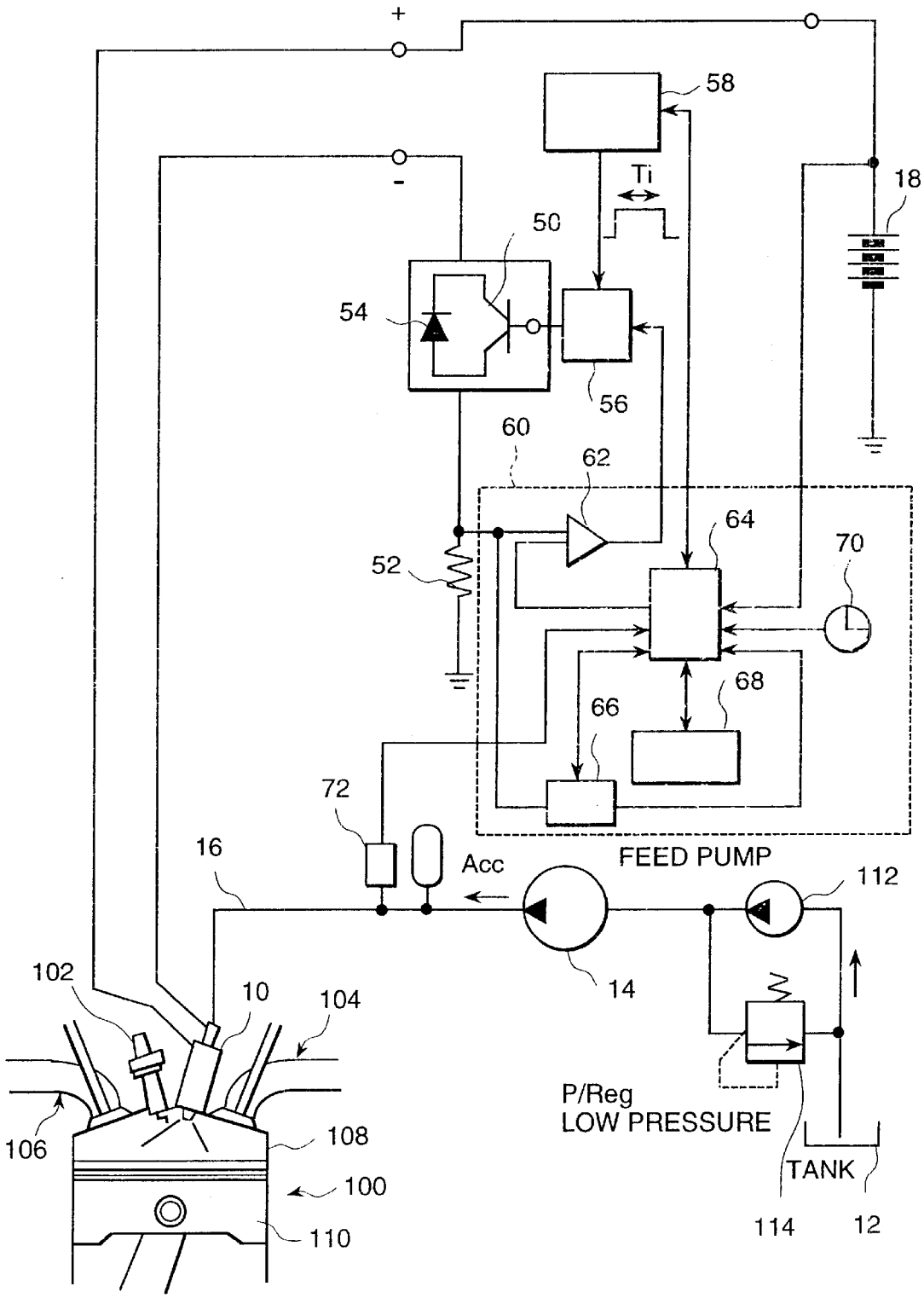
FIG. 18 is a block diagram illustrating the configuration of the internal combustion engine in which the fuel injector system shown in FIG. 1 is employed.

With reference to FIG. 18, an embodiment in which the electromagnetic fuel injector system shown in FIG. 1 is applied to an internal combustion engine for a vehicle; will be described. In FIG. 18, an engine 100 constituting the internal combustion engine comprises an igniter 102, a suction manifold 104, an exhaust manifold 106, a cylinder 108 and a piston 110. The cylinder 108 has injector valve 10 mounted thereon. A fuel feed pump 112, a pressure regulator 114 and the like together with the fuel pressure sensor 72 and fuel pump 14 are arranged on the fuel passage 16 connecting this injector 10 and to fuel tank 12. The cylinder 108 accommodates a freely reciprocating piston 110. The suction manifold 104 serves to deliver air into the cylinder 108, the exhaust manifold 106 serves to discharge exhaust gas from the cylinder 108, injector valve 10 operates to inject fuel into the cylinder 108 and the igniter 102 operates to ignite fuel in the cylinder 108.

This internal combustion engine is configured in such a way that, after being supplied to the fuel pump 14 by the feed pump 12, the fuel in the fuel tank 12 is fed to injector 10 in a pressurized state through the fuel passage 16 by the fuel pump 14. The engine controller 58 determines the injection timing and injection voltage in conformity to various working conditions of the engine 100 based on the information gained from various sensors (not illustrated) and sends the injection command pulse conforming to this determination to the current control circuit 56. The current control circuit 56 turns on the power transistor 50 in response to the injection command pulse so that current is applied to power transistor 50. In the process of increasing the current flowing to coil 20 in the injector valve 10 after the power transistor 50 is turned on, a target peak current value in conformity to battery voltage, fuel pressure and coil/harness resistance is read out of the target peak current storage unit 68. If agreement is found between the read-out target peak current and current flowing to coil 20, the current flowing to the power transistor 50 is switched over to the holding current by the switching command from the comparator 62. Then, the injector valve 10 jets out the fuel at the optimum injection volume in conformity to various operation modes of the internal combustion engine.

Figure 19:
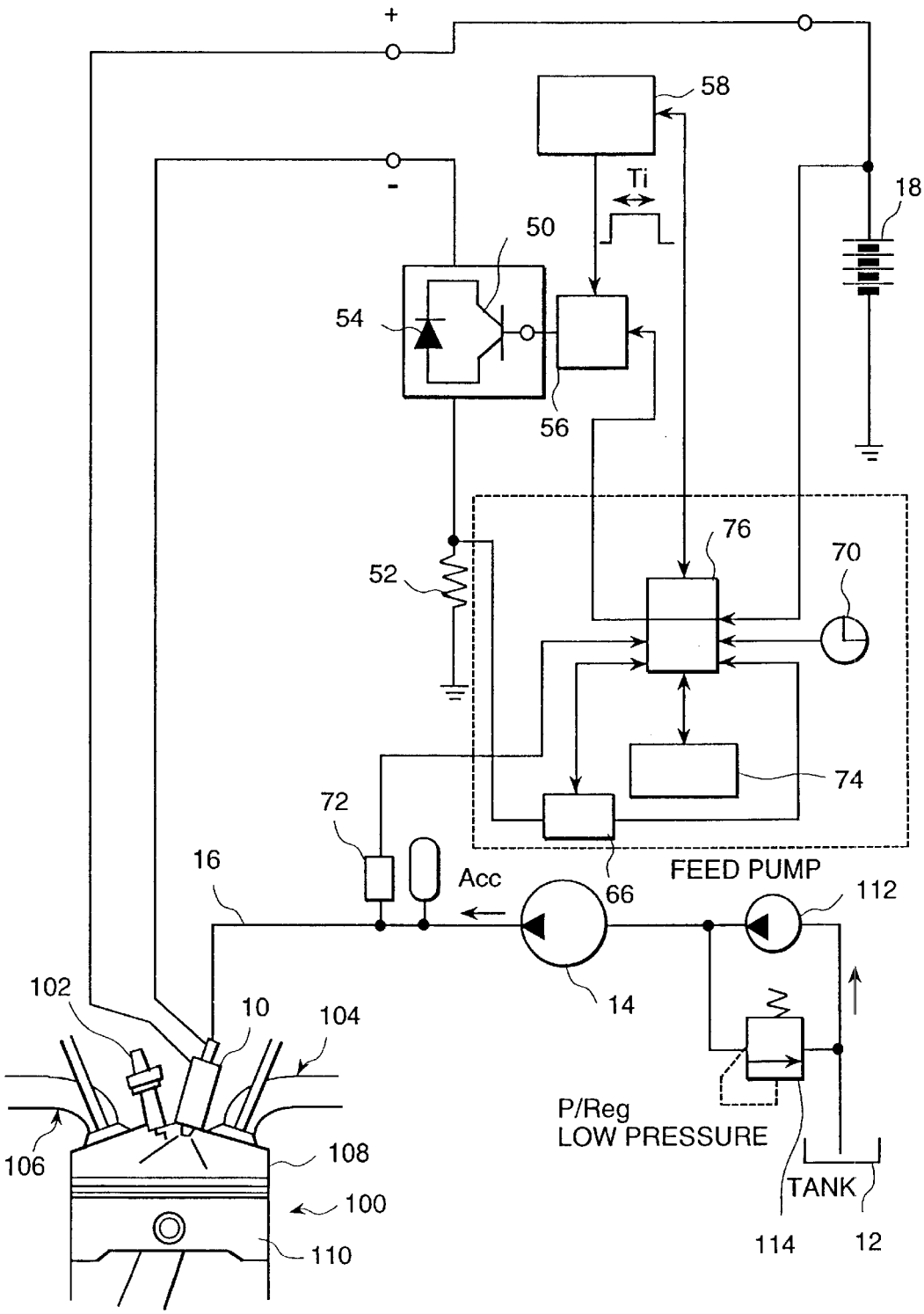
FIG. 19 is a block diagram illustrating the configuration of the internal combustion engine in which the fuel injector system shown in FIG. 3 is employed.

FIG. 19 shows a block diagram of an embodiment in which the electromagnetic fuel injector shown in FIG. 3 is applied to the internal combustion engine.

In the present embodiment, an ON-signal is sent from the current control circuit 56 to the power transistor 50 in response to an injection command pulse coming from the engine controller 58. After the start of current application to the coil 20 in the injector valve 10, the time that has elapsed from the start of current application is measured by the switching timing determining unit 76. In the switching timing determining unit 76, a target switching timing (target switching time) in conformity to battery voltage, fuel pressure and coil/harness resistance is read out of the target switching time storage unit 74. If agreement is found between target switching timing and the time measured by the: switching timing determining unit 76, the current flowing to coil 20 is switched to a holding current. This allows the injector valve 10 to jet out fuel according to the optimum injection volume characteristics conforming to various operation modes of the internal combustion engine.

The cylinder internal injection engine has been described with reference to various embodiments; however, the electromagnetic fuel injector system according to said various embodiments can also be applied to other types of engines.

The present invention allows the coil to be driven in the optimum drive current waveform conforming to the changes in battery voltage, coil/harness resistance and fuel pressure. This makes it possible to get the optimum fuel injection characteristics for each mode.

The present embodiment allows the optimum fuel injection conforming to each operation mode according to battery voltage, coil/harness resistance and fuel pressure in the internal combustion engine equipped with an electromagnetic fuel injector system. This provides an internal combustion engine characterized by low fuel costs and high power.

In the embodiment described with reference to FIGS. 4 and 11, both the target peak current value and the peak arrival time for the combined resistance, including the resistance of a current application circuit to connect the battery with the coil and the resistance of the coil, are stored. In other words, the target peak current value and peak arrival time are associated with each other and are stored, and it is preferred that the state be switched over to the state of current application where the target current value is equal to the holding current, if either the current value or the time elapsed after start of current application has reached the target. This avoids the current being unduly increased, thereby reducing the power consumption and any delay in valve closing. In a fuel injector system in which the electromagnetic fuel injection valve is driven by a battery voltage, a reduction in power consumption decreases battery consumption, thereby making a significant contribution to improvement of the startup characteristics.

As discussed above, the target peak current value conforming to the battery voltage is selected in the event of changes in battery voltage. When the coil current has reached the target peak current value, it is switched over to the holding current. Or, the target switching timing conforming to battery voltage is selected. When the time that has elapsed after the start of current application has reached the target switching time, a holding current smaller than the coil current value at this time is fed to the coil. This method prevents the peak current from being applied to the coil for an unduly long time, and an excessive attraction force from being generated out of the coil, and allows optimum linearity of the injection volume characteristics to be maintained.

When there is a change in the combined resistance (harness resistance) including the resistance of a current application circuit to connect the battery with the coil and the resistance of the coil, a target peak current value conforming to this combined resistance is selected. When the coil current has reached the target peak current value, the current is switched over to the holding current. Or, the target switching timing conforming to the combined resistance is selected. When the time that has elapsed after the start of current application to the coil has reached the selected target switching time, a holding current smaller than the coil current value at this time is fed to the coil. This method prevents the peak current from being applied to the coil for an unduly long time, and excessive attraction force from being generated out of the coil, and allows optimum linearity of the injection volume characteristics to be maintained.

If there is a change in the pressure of the fuel in the fuel passage, a target peak current value conforming to fuel pressure is selected. When the coil current has reached the target peak current value after current application to the coil, the current is switched over to the holding current. Or, a target switching timing is selected in conformity to the pressure of the fuel in the fuel passage. When the time that has elapsed after the start of current application to the coil has reached the selected target switching time, a holding current smaller than the coil current value at this time is selected. This method prevents the peak current, from being applied to the coil for an unduly long time, and excessive attraction force from being generated out of the coil, and allows optimum linearity of the injection volume characteristics to be maintained.

What is claimed is:

1. A fuel injector system comprising a current application controller which controls an operation of an electromagnetic fuel injection valve having a coil to operate a valve body, (A) by controlling current so that current flows to said coil to generate a magnetic force for driving said valve body until the current driving said valve body in the direction of opening the valve becomes greater than the current needed for holding said valve body open, and (B) by controlling current so that a change occurs to the time of current application when driving said valve body in a direction of opening;

wherein said current application controller allows current to be applied, to reduce a maximum current in the event of increase of said current application time during current application when driving said valve body in the direction of opening said valve; and a voltage detecting device to detect a voltage of a battery connected to a current application circuit; wherein a storage device stores a relationship between said current with respect to plural battery voltages and a combined resistance, and estimates the changes of the combined resistance, including the resistance of said current application circuit and the resistance of the coil connected to said current application circuit, based on a battery voltage detected by said voltage detecting device.

2. A fuel injector system comprising a current application controller which controls an operation of an electromagnetic fuel injection valve having a coil to operate a valve body, (A) by controlling current so that current flows to said coil to generate a magnetic force for driving said valve body until the current driving said valve body in the direction of opening the valve becomes greater than the current needed for holding said valve body open, and (B) by controlling current so that a change occurs to the time of current application when driving said valve body in a direction of opening;

wherein said current application controller allows current to be applied, to reduce a maximum current in the event of increase of said current application time during current application when driving said valve body in the direction of opening said valve; and voltage detecting means to detect a voltage of the battery connected to a current application circuit, wherein a storage device to store a relationship between current and a combined resistance stores the relationship between said current value with respect to plural battery voltages and said combined resistance, and the changes in the combined resistance, including the resistance of said current application circuit and the resistance of the coil connected to said current application circuit, are estimated, based on the battery voltage detected by said voltage detecting means.

3. A fuel injector system comprising a current application controller which controls the operation of an electromagnetic fuel injection valve having a coil to operate a valve body, (A) by controlling current so that current flows to said coil to generate a magnetic force for driving said valve body until the current driving said valve body in the direction of opening the valve becomes greater than the current needed for holding said valve body open, and (B) by controlling current so that a change occurs to the time of current application when driving said valve body in the direction of opening;

wherein said current application controller controls current application to a coil according to a fuel injection command pulse compensated to have a long pulse width, in the event of increase of said current application time when driving said valve body in the direction of opening said valve.

4. A fuel injector system comprising a current application controller which controls the operation of an electromagnetic fuel injection valve having a coil to operate a valve body, (A) by controlling current so that current flows to coil to generate a magnetic force for driving said valve body until the current driving said valve body in the direction of opening the valve becomes greater than the current needed for holding said valve body open, and (B) by controlling current so that a change occurs to the time of current application when driving said valve body in the direction of opening;

wherein said fuel injector system further comprises a combined resistance estimating means to estimate a combined resistance, including the resistance of said current application circuit electrically connected between the battery and said coil to supply current thereto and to said coil, and the resistance of said coil;

and wherein said current application controller is characterized by controlling current to the coil, based on a fuel injection command pulse having a width compensated in conformity to the resistance estimated by said combined resistance estimating means.

5. An internal combustion engine comprising:

(1) a cylinder to accommodate a freely reciprocating piston;

(2) an air suction means to introduce air into said cylinder;

(3) a gas exhausting means to discharge exhaust gas from said cylinder;

(4) a fuel injector system to inject fuel into said cylinder; and (5) an igniting means to ignite said fuel in said cylinder;

wherein said internal combustion engine has a fuel injector system according to any one of claim 1, claim 3 and claim 4 as, said fuel injector system.

6. The fuel injector system of claim 1, wherein said current application controller comprises a first device to provide current up to a peak current value during a valve opening condition and to provide current about a holding current value during a valve holding condition; and said voltage detecting device to detect said voltage of said battery and to communicate a lowering of said voltage of said battery to said first device, said first device to lower said peak current value in response to said lowering of said voltage of said battery.

7. The fuel injector system of claim 6, wherein said first device continuously provides said current during said valve opening condition, and said voltage detecting device intermittently provides said current during said valve holding condition.

8. The fuel injector system of claim 6, wherein said first device lengthens a total time to provide said current when said first device lowers said peak current value.

9. The fuel injector system of claim 6, wherein said first device provides said current to said coil of said fuel injection valve.

10. The fuel injector system of claim 6, wherein said holding current value is lower than said peak current value.

11. The fuel injector system of claim 1, wherein said current application controller comprises a device to provide current up to a peak current value during a first period of a value opening and to provide current about a holding current value during a second period of said value opening subsequent to said first period, said device to lower said peak current value when a battery voltage lowers.

12. The fuel injector system of claim 11, wherein said device continuously provides said current in said first period and said device intermittently provides said current in said second period.

13. The fuel injector system of claim 11, wherein said device lengthens a total time to apply said current when said device lowers said peak current value.

14. The fuel injector system of claim 11, wherein said device provides said current to said coil of said fuel injection valve.

15. The fuel injector system of claim 11, wherein said holding current value is lower than said peak current value.

* * * * *